US007601099B2

(12) United States Patent
Kang

(10) Patent No.: US 7,601,099 B2
(45) Date of Patent: Oct. 13, 2009

(54) METHOD FOR PROVIDING A FEEDBACK-CONTROLLED EXERCISE ROUTINE

(76) Inventor: Brian J Kang, 1 Closter Commons # 148, Closter, NJ (US) 07624

( * ) Notice: Subject to any disclaimer, the term of this patent is extended or adjusted under 35 U.S.C. 154(b) by 676 days.

(21) Appl. No.: 11/375,084

(22) Filed: Mar. 13, 2006

(65) Prior Publication Data

US 2006/0201580 A1 Sep. 14, 2006

Related U.S. Application Data

(60) Provisional application No. 60/661,009, filed on Mar. 14, 2005.

(51) Int. Cl.
*A63B 71/00* (2006.01)

(52) U.S. Cl. ..... 482/8; 482/1; 482/9; 482/900; 434/250

(58) Field of Classification Search ..... 482/1–9, 482/83–90, 900–902; 434/247, 250, 252
See application file for complete search history.

(56) References Cited

U.S. PATENT DOCUMENTS 482,623 A 9/1892 Dooling
4,440,400 A 4/1984 Neuberger ..... 273/411
4,534,557 A 8/1985 Bigelow et al. ..... 273/55 A
4,824,237 A * 4/1989 Ratner et al. ..... 351/203
4,850,224 A 7/1989 Timme ..... 73/379
6,110,079 A 8/2000 Luedke et al. ..... 482/83
6,159,016 A * 12/2000 Lubell et al. ..... 434/247
6,537,076 B2 * 3/2003 McNitt et al. ..... 434/252
7,095,388 B2 * 8/2006 Truxa et al. ..... 345/7

FOREIGN PATENT DOCUMENTS

WO WO 02/17784 A1 3/2002

* cited by examiner

*Primary Examiner*—Glenn Richman
(74) *Attorney, Agent, or Firm*—Winston & Strawn LLP

(57) ABSTRACT

A method for providing a feedback-controlled exercise routine for a user by providing a predetermined sequence of movements for the user; sensing movements of the user during the sequence; measuring data related to the sensed movements; and evaluating the data to determine whether to repeat or modify the routine. The method can also include storing the user's exercise routine on a user key, displaying exercise instructions to the user from the user key to illustrate the sequence of movements, with the evaluation of the data including modifying the displayed exercise instructions, and storing an updated user exercise routine after successful completion of the routine, wherein the updated routine includes the modified exercise instructions.

16 Claims, 23 Drawing Sheets

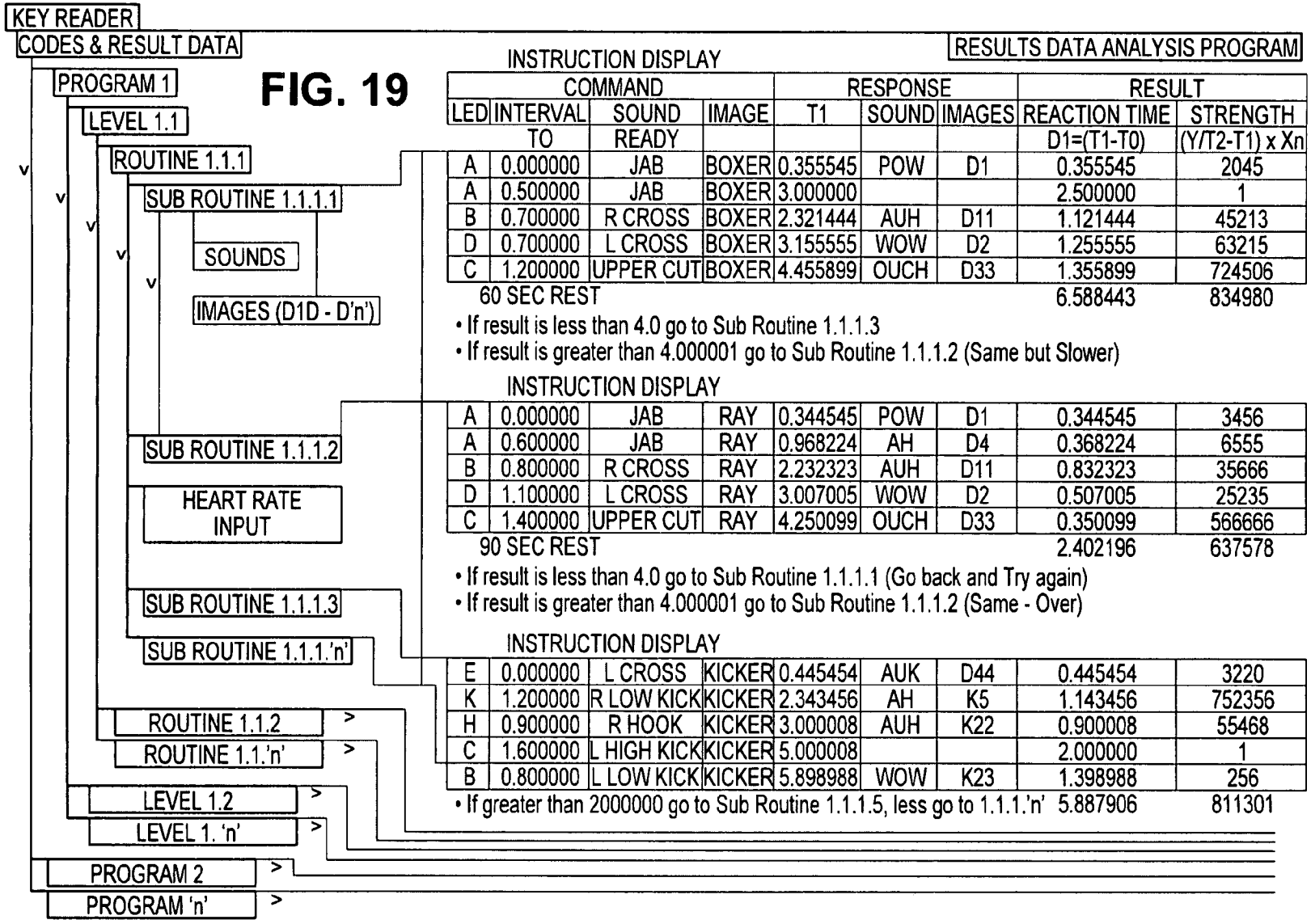

FIG. 19

| COMMAND | | | | RESPONSE | | | RESULT | |
|---|---|---|---|---|---|---|---|---|
| LED | INTERVAL TO | SOUND READY | IMAGE | T1 | SOUND | IMAGES | REACTION TIME D1=(T1-T0) | STRENGTH (Y/T2-T1) x Xn |
| A | 0.000000 | JAB | BOXER | 0.355545 | POW | D1 | 0.355545 | 2045 |
| A | 0.500000 | JAB | BOXER | 3.000000 | | | 2.500000 | 1 |
| B | 0.700000 | R CROSS | BOXER | 2.321444 | AUH | D11 | 1.121444 | 45213 |
| D | 0.700000 | L CROSS | BOXER | 3.155555 | WOW | D2 | 1.255555 | 63215 |
| C | 1.200000 | UPPER CUT | BOXER | 4.455899 | OUCH | D33 | 1.355899 | 724506 |
| 60 SEC REST | | | | | | | 6.588443 | 834980 |

| | | | | | | | | |
|---|---|---|---|---|---|---|---|---|
| A | 0.000000 | JAB | RAY | 0.344545 | POW | D1 | 0.344545 | 3456 |
| A | 0.600000 | JAB | RAY | 0.968224 | AH | D4 | 0.368224 | 6555 |
| B | 0.800000 | R CROSS | RAY | 2.232323 | AUH | D11 | 0.832323 | 35666 |
| D | 1.100000 | L CROSS | RAY | 3.007005 | WOW | D2 | 0.507005 | 25235 |
| C | 1.400000 | UPPER CUT | RAY | 4.250099 | OUCH | D33 | 0.350099 | 566666 |
| 90 SEC REST | | | | | | | 2.402196 | 637578 |

| | | | | | | | | |
|---|---|---|---|---|---|---|---|---|
| E | 0.000000 | L CROSS | KICKER | 0.445454 | AUK | D44 | 0.445454 | 3220 |
| K | 1.200000 | R LOW KICK | KICKER | 2.343456 | AH | K5 | 1.143456 | 752356 |
| H | 0.900000 | R HOOK | KICKER | 3.000008 | AUH | K22 | 0.900008 | 55468 |
| C | 1.600000 | L HIGH KICK | KICKER | 5.000008 | | | 2.000000 | 1 |
| B | 0.800000 | L LOW KICK | KICKER | 5.898988 | WOW | K23 | 1.398988 | 256 |
| | | | | | | | 5.887906 | 811301 |

METHOD FOR PROVIDING A FEEDBACK-CONTROLLED EXERCISE ROUTINE

This application claims the benefit of and priority to U.S. Provisional Application No. 60/661,009, filed Mar. 14, 2005, the entire content of which is expressly incorporated herein by reference thereto.

BACKGROUND OF THE INVENTION

1. Field of the Invention

The present teachings relate to an interactive virtual personal trainer and method that allow a user to achieve an individualized full-body workout. More particularly, the present teachings relate to a feedback-responsive training system and method that allow a user to train according to a choreographed full-contact audio/video routine during which the quality of impacts exerted by the user are evaluated and feedback in the form of routine variation and audio/visual instructions are provided. The virtual trainer system and method can thereby provide the user with real-time workout analysis and customized audio/video instruction simulating a personal workout session coached by an experienced human personal trainer.

2. Description of Related Art

Known exercise devices for contact-related workouts provide a limited amount of feedback with respect to the quality of the exercise a user is performing. Many of these devices provide a random or programmed sequence of targets on an object that is to be struck. The target is usually a visual stimulus, such as a light, or an auditory stimulus, such as a tone from a speaker.

When using these known devices, the user is prompted to react with some type of striking response. The striking response is usually a jab, punch, block, kick, or combination thereof, that results in impacting or triggering the target with varying degrees of speed and/or force. Characteristics of the striking response such as response time can then be evaluated and fed back to the user as variable sounds or tones. At the end of the prompted sequence, a total score is tallied to provide the user with an indication of the total number and quality of strikes that the target has taken. For example, U.S. Pat. Nos. 3,933,354, 4,818,234, 4,974,833, 5,899,809, 6,110,079, and 6,464,622 disclose target devices with electronic sensors and signaling devices which can be struck by the user. These known exercise devices can be referred to as Go/No Go systems because they evaluate and store the requested strike response and then automatically go to the next target in sequence until a total score is provided at the end of the sequence.

Other known systems are designed to provide feedback based upon a measurement of the power of a strike response. For example, U.S. Patent Application Publication No. US 2003/0216228 A1 provides a sparring partner device that is designed to receive strikes and blows and to measure the intensity thereof. The intensity of each strike is used to lookup a tone sequence that is played on a speaker. When the sum of force values equals a preset value corresponding to a TKO setting, the workout or match ends. JP Pat. No. 40127480A provides a boxing game that displays blows imparted to a dummy opponent on a monitor as the player strikes a blow bag. When accumulated damage to either the dummy or the player is in excess of a specified value, a knockout is reported and the game ends.

Known devices lack the ability to provide users with an interactive feedback-controlled audiovisual workout that challenges and motivates users during the workout to achieve maximum benefits. Accordingly, a need exists for a training system that simulates a full-contact type workout of the type achieved when being coached by an experienced human personal trainer.

SUMMARY OF THE INVENTION

The invention relates to a method for providing a feedback-controlled exercise routine for a user which comprises providing a predetermined sequence of movements for the user; sensing movements of the user during the sequence; measuring data related to the sensed movements; and evaluating the data to determine whether to repeat or modify the routine. This can be used both for physical exercises, where the movements involve force applying movements as well as mental exercises, where the user is instructed to follow a sequence in order within a specified time.

The method include a number of preferred embodiments including storing the user's exercise routine on a user key. This enables the exercise instructions to be displayed to the user from the user key to illustrate the sequence of movements. If desired, an audio signal, used alone or in combination with the displayed information, can be transmitted to convey these instructions to the user.

The evaluation of the data can include modifying the displayed exercise instructions, and storing an updated user exercise routine on the user key after successful completion of the routine wherein the updated routine includes the modified exercise instructions. Preferably, the predetermined sequence includes the sequential illumination of indicators and the user movements are sensed by applying an impact force to a sensor associated with the illuminated indicator. The measured data can be converted into a response time or an amount of force applied to the sensor, and further wherein the data is evaluated to determine user compliance with predetermined response times or minimum applied force requirements, or both, achieved during the exercise routine, so that the sequence can be modified to facilitate user compliance. The sequence can be modified by running faster if the user was in compliance with the routine or by running slower if the user was not in compliance with the routine. The sequence can be modified to provide a more complex routine, such as having the complexity increased by varying the sequence, by running the sequence faster, by adding further requirements to the sequence or by a combination of these.

The movements are advantageously sensed by contacting a sensor on a body. The body is generally an impact receiving body and the movements are sensed by applying an impact force to the sensor. Preferably, an illuminable member is provided in the sensor so that illumination of the member indicates that the sensor is to be contacted in order for the user to comply with the routine. As noted, an audio transmission can be provided to the user to describe or implement the routine or to provide feedback on user compliance with the routine. As a safety precaution, one or more physical parameters of the user can be monitored with the instructions for user movements terminated if a physical parameter exceeds a safety value.

BRIEF DESCRIPTION OF THE DRAWINGS

Additional features and advantages of various embodiments will be set forth in part in the description that follows, and in part will be apparent from the description, or may be learned by practice of various embodiments described therein and as shown in the drawings, wherein:

FIG. 19 shows the generation and processing of data and the generation of sounds and images for a sample workout program.

DETAILED DESCRIPTION OF THE PREFERRED EMBODIMENTS

Figure 1:
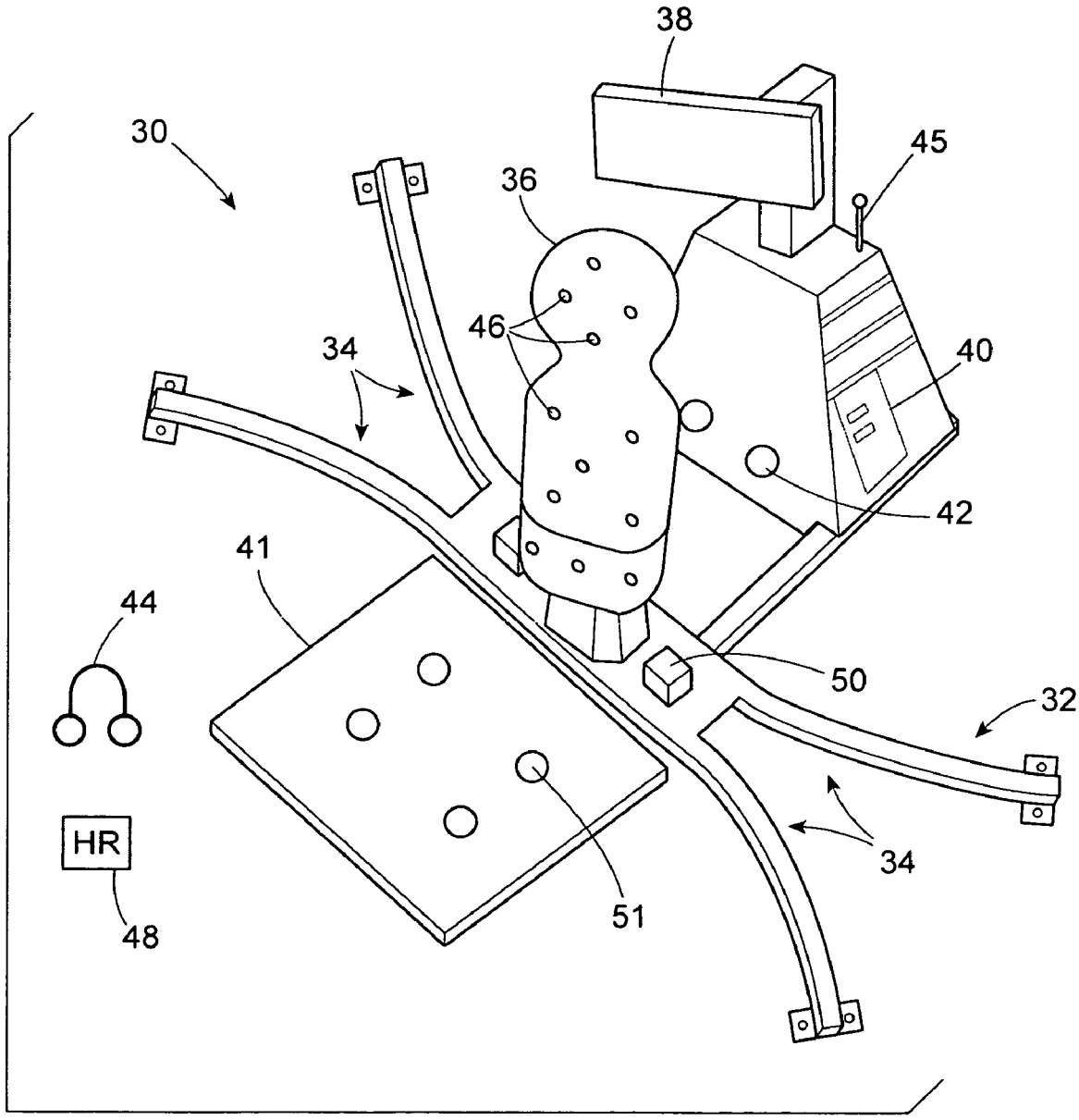
FIG. 1 is a perspective view of an interactive virtual personal trainer system according to various embodiments.

The advantages of the various embodiments of the invention will be realized and attained by means of the elements and combinations particularly pointed out in the description herein. It is to be understood that both the foregoing general description and the following detailed description are exemplary and explanatory only, and are intended to provide a description of the preferred embodiments of the invention.

The interactive virtual personal trainer and method of the present teachings provides real-time feedback based upon evaluations of the quality of the impact responses during the course of running a programmed full-contact workout. The feedback is in the form of impact-dependent routine variations and audiovisual instructions. By providing the user with immediate feedback continuously, the virtual personal trainer of the present teachings increases motivation, decreases boredom, and achieves better and quicker skill development compared to known exercise devices.

The most preferred embodiment is a virtual trainer system comprising an impact receiving body that is capable of being struck by a user. The impact receiving body can include a plurality of illuminable impact sensors arranged on the impact receiving body that can be configured to receive impact responses from the user. A display unit can be operable to receive signals and broadcast images and audio signals. A control unit can be operatively coupled to the plurality of illuminable impact sensors and to the display unit. The system can be configured such that the control unit is operable to run an interactive workout program that directs the control unit to: a.) send a signal to the display unit and the one or more illuminable impact sensors that requests an impact-dependent response routine to be performed by the user; b.) wait a preset period of time for one or more impact responses from the user; and c.) provide a variable signal to the display unit and the one or more illuminable impact sensors that requests the user to either repeat the previous impact-dependent response routine or progress to a new impact-dependent response routine depending upon a measured response time and a calculated strength value of the one or more impact responses performed by the user.

The present invention also provides a method of providing an interactive feedback-controlled workout. The method includes providing a virtual trainer having an impact receiving body including a plurality of illuminable impact sensors arranged thereon, a display unit operable to emit images and a corresponding audio signal, and a control unit operatively coupled to the plurality of illuminable impact sensors and to the display unit. The method also includes broadcasting a video image and a corresponding audio signal on the display unit to instruct a user to perform an impact-dependent response routine. The method further includes illuminating one or more of the illuminable impact sensors to provide the user with a visual indication on the impact receiving body where to impart one or more impact responses in order to perform the impact-dependent response routine. The method includes waiting a preset period of time for the one or more impact responses from the user, and providing a variable feedback signal to the video display unit and the one or more illuminable impact sensors requesting the user to either repeat the previous impact-dependent response routine or progress to a new impact-dependent response routine dependent upon a measured response time and a calculated strength value of the one or more impact responses performed by the user.

Operation of the training system and method are facilitated by the novel impact detector assembly that has been developed. The impact detector assembly comprises a hollow body including an exit aperture and a block having a cylinder bore formed therein. The block can include an inlet passageway arranged in fluid communication with the cylinder bore. A piston can be reciprocally arranged in the cylinder bore. A hose can be fluidically connected to the exit aperture of the hollow body at one end of the hose and the inlet passageway of the cylinder block at the other end of the hose. A plurality of sensors can be configured with the cylinder block in the vicinity of the cylinder bore and each of the plurality of sensors are operable to produce a responsive signal as the piston moves past the respective sensor. A control unit can be operatively connected to the plurality of sensors and capable of receiving the responsive signals from each of the plurality of sensors when the piston is moved by way of a pressure pulse produced by impacting the hollow body.

The interactive virtual personal trainer system 30 according to various embodiments is generally shown in FIG. 1. FIGS. 20-29 also show various additional views of the virtual personal trainer system 30. The interactive virtual personal trainer system 30 allows a user to achieve a full-contact, full-body workout that includes unlimited combinations of punching, kicking, elbow-punching, knee-kicking, guided footwork, and the like.

The interactive virtual personal trainer system 30 according to various embodiments is capable of selectively running various choreographed, audiovisual, full-contact fitness workout software programs. The fitness workout programs can include, for example, targeted upper and/or lower body workouts, stress-relief workouts, extreme/intense/challenging workouts, military training workouts, police training workouts, self-defense workouts, and unlimited other types of workouts. While running the choreographed workout routines, the interactive virtual personal trainer system 30 can instruct the user to perform a specific impact-dependent response routine and can then measure and evaluate the quality of each impact response. For example, the evaluated quality of the impact response can include measuring the strength/power of the impact response and the response time of the impact response. These calculations can then be used to determine in real-time, or substantially in real-time, whether to repeat the previous impact-responsive instruction or progress to a new impact responsive instruction. The feedback-responsive system and method according to various embodiments can thereby provide the user with a workout analysis in real-time that simulates a personal workout session coached by an experienced human personal trainer.

Referring to FIG. 1, the interactive virtual personal trainer system 30 can include a support platform 32 that can stably support one or more of the various components of the system 30. The support platform 32 can include a plurality of structural members 34 that can provide support and stability to the system 30 when exposed to forces inflicted by users of all ages and strength levels. According to various embodiments, auxiliary structures 50 can be arranged on portions of the support platform 32. These auxiliary structures 50 can be referenced as part of the choreographed workout program being run by the system 30. For example, the auxiliary structures 50 can include stretching blocks to aid the user in conducting stretching and warm-up-type exercises at the beginning of a choreographed workout program.

An impact receiving body 36 can be supported by the platform 32. The impact receiving body 36 can take the general shape of the head and/or torso of a human adversary or any other shape as will be described below. One or more impact sensors 46 can be arranged on the impact receiving body 36. Each impact sensor 46 can be mated to a corresponding indicator that can be selectively operable and controlled to produce a user perceivable signal, such as, for example, a light signal. The user perceivable signal emitted by each of the indicators can operate to notify the user that a particular impact sensor 46 is waiting for a responsive impact from the user.

According to various embodiments, a mat 41 can be arranged to be used with the interactive virtual personal trainer system 30. The mat 41 can be moveable and can operate to generally guide the user where to stand with respect to the impact receiving body 36 during at least the start of a workout. For example, the mat 41 can be positioned in front of the impact receiving body 36. According to various embodiments, the mat 41 could have numbered or lettered footwork position guides 51 arranged thereon such that particular foot positions could be referenced as part of the choreographed workout program being run by the system 30. According to various embodiments, each footwork position guide 51 on the mat 41 could include a sensor that can sense whether a user's foot is properly placed thereon during the workout.

To broadcast audiovisual workout instructions to a user, the system 30 can be provided with a display unit. The display unit can include one or more video monitors 38 and one or more speaker units 42. The one or more video monitors 38 can be arranged such that the user is capable of viewing video workout instructions no matter where they are standing with respect to the impact receiving body 36. Numerous types of displays may be utilized, such as LCD, LED, Electronic ink, plasma, CRT, analog, and the like. The one or more speaker units 42 can be arranged such that the user can hear audio workout instructions while corresponding images are being broadcast on the one or more video monitors 38. If desired, instead of the preferred use of a display, an audio transmission to earphone or headphones either by hard wiring or wirelessly can be employed. According to the display or audio-only embodiments, a volume control mechanism can be provided to adjust the volume for a given setup. An ambient noise compensation mechanism can be implemented that can register the ambient noise and modulate the volume to fully or partially compensate for the ambient conditions.

The system 30 can be provided with a headset 44 such that a user can be provided with audio instructions without bothering others or having ambient noise drown out the audio instructions being broadcast. The system 30 can be provided with one or more additional connectable accessories 48 that can broadcast information to the user and/or monitor the physical state of the user, such as, for example, a heart rate monitor or a balance sensor. If the physical parameters that are measured exceed certain predetermined values, the program can display and state a warning to advise the user to discontinue physical activities.

According to various embodiments, the one or more video monitors 38, the one or more speaker units 42, the headset 44, and the other connectable accessories 48 can be arranged to receive and emit signals in a wired or a wireless manner from a control unit 40. An antenna 45 is shown in the vicinity of the control unit 40 for this purpose.

The control unit 40 is operable to control the operation of the interactive virtual personal trainer system 30. The control unit 40 can include an all-purpose digital microcomputer. The control unit 40 can include various subcomponents, such as, for example, a CPU, an analog to digital converter, a multiplexer, a memory module, auxiliary devices, supplemental sensors, a power supply. The control unit 40 can be in operative communication with the one or more video monitors 38, the one or more speaker units 42, the one or more impact sensors 46, the one or more indicators, and the one or more connectable accessories 48, as well as other signal receiving and/or signal producing devices. As will be more fully described below, the control unit 40 can be programmed to control the components of the interactive virtual personal trainer in a manner that simulates a full-contact interactive personal workout session.

According to various embodiments, the control unit 40 can include a recordable media drive (not shown in FIG. 1) that can be arranged in a user-accessible location. The recordable media drive can be arranged to allow a user to selectively load their choice of workout programs into the recordable media drive. Accordingly, the workout program run by the control unit 40 can be chosen by the user depending on the characteristics and needs of the user, such as for example, skill level achieved, age, ability, sport, martial arts belt color, and the like. The recordable media drive could be arranged to allow the recording of data thereon, such as the history of workout results, user performances, baseline comparison data, and the like.

Figure 28:
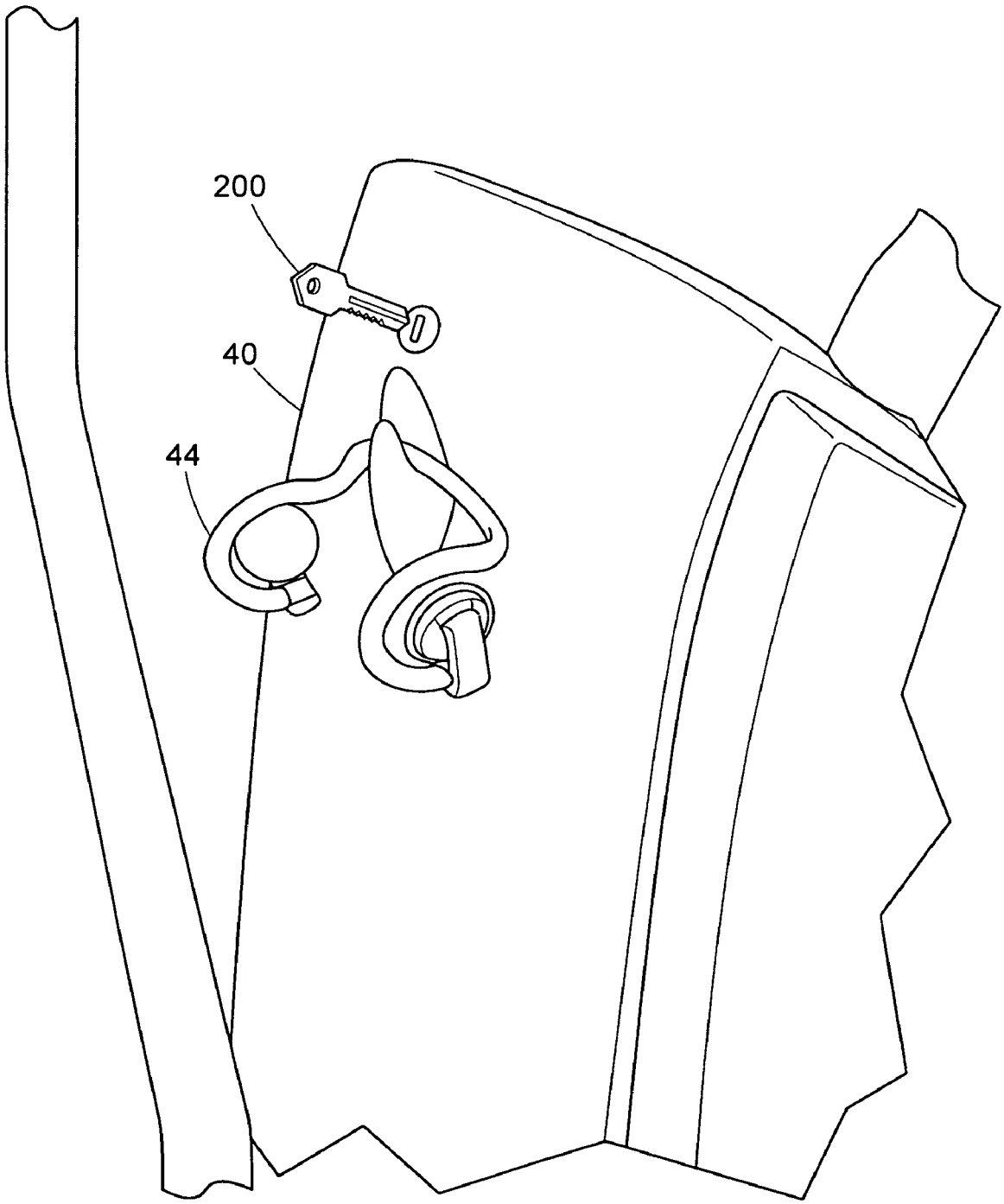
Figure 29:
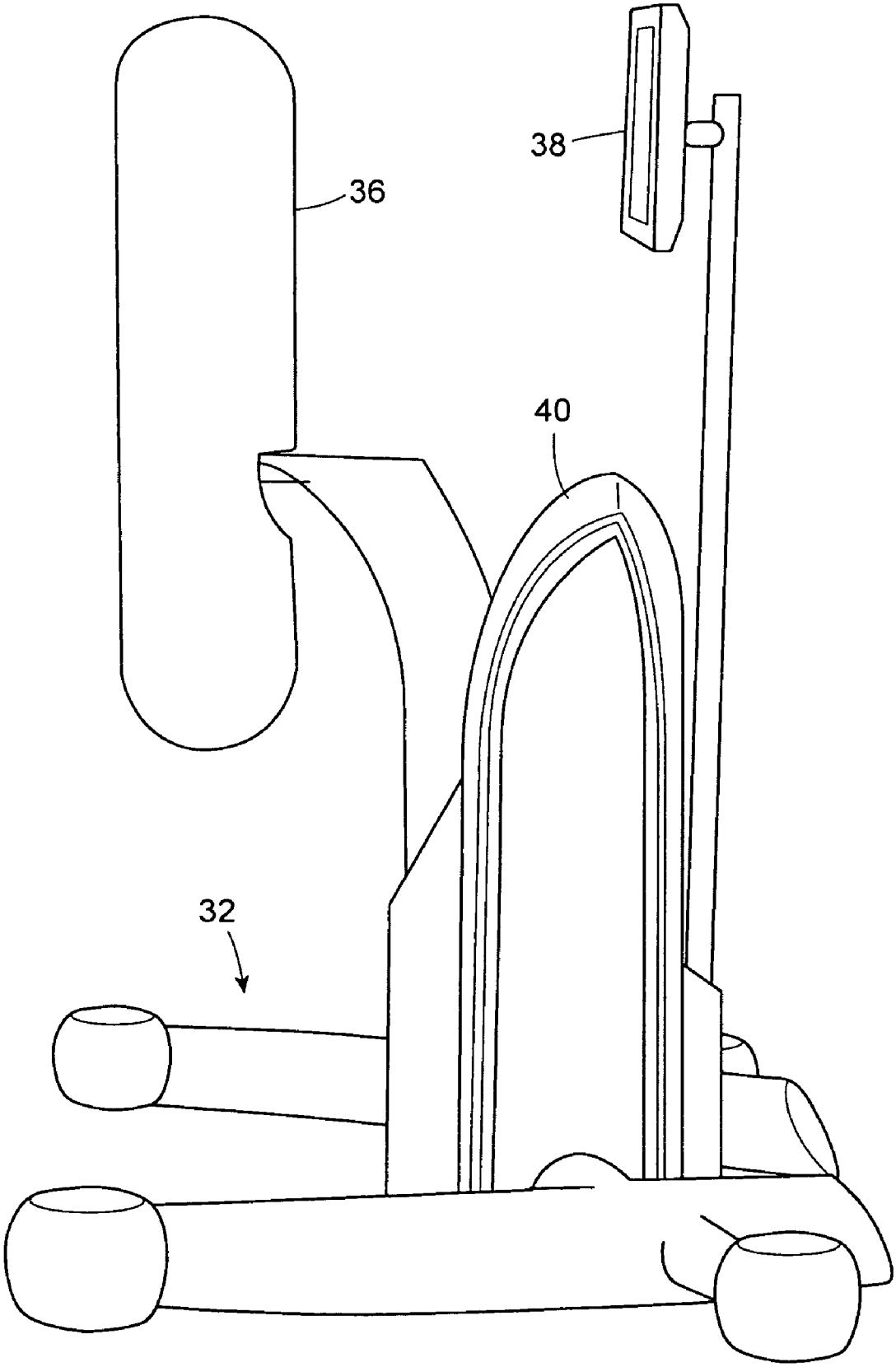

In addition or in the alternative, the control unit 40 could be pre-loaded with a plurality of workout programs that can be reviewed and selected by the user at the beginning of a workout session. As will be more fully described below with reference to FIG. 14, the user could be provided with a pre-programmed user key such as, for example, a flash memory key card or fob that could have data such as, for example, the user's pre-selected personal workout preferences saved thereon that could be inserted into the control unit 40. The pre-programmed user key can operate to select the workout program to be run when inserted into the interactive virtual personal trainer system 30 by the user. Moreover, data could be sent to the pre-programmed user key from the control unit 40 and saved on the user key for retrieval and use during future workouts. Such a user key or fob 200 is shown in FIG. 28 being inserted into a control unit 40 of the interactive virtual personal trainer system 30.

According to various embodiments, the interactive virtual personal trainer system 30 shown in FIG. 1 can include other supports, mounting arrangements, impact receiving bodies, audiovisual components, impact sensors, control units, without departing from the scope of the present teachings.

The interactive virtual personal trainer system 30 according to various specific embodiments is also shown in FIGS. 20-29 which illustrate at least the components of the system 30 disclosed above.

Figure 2:
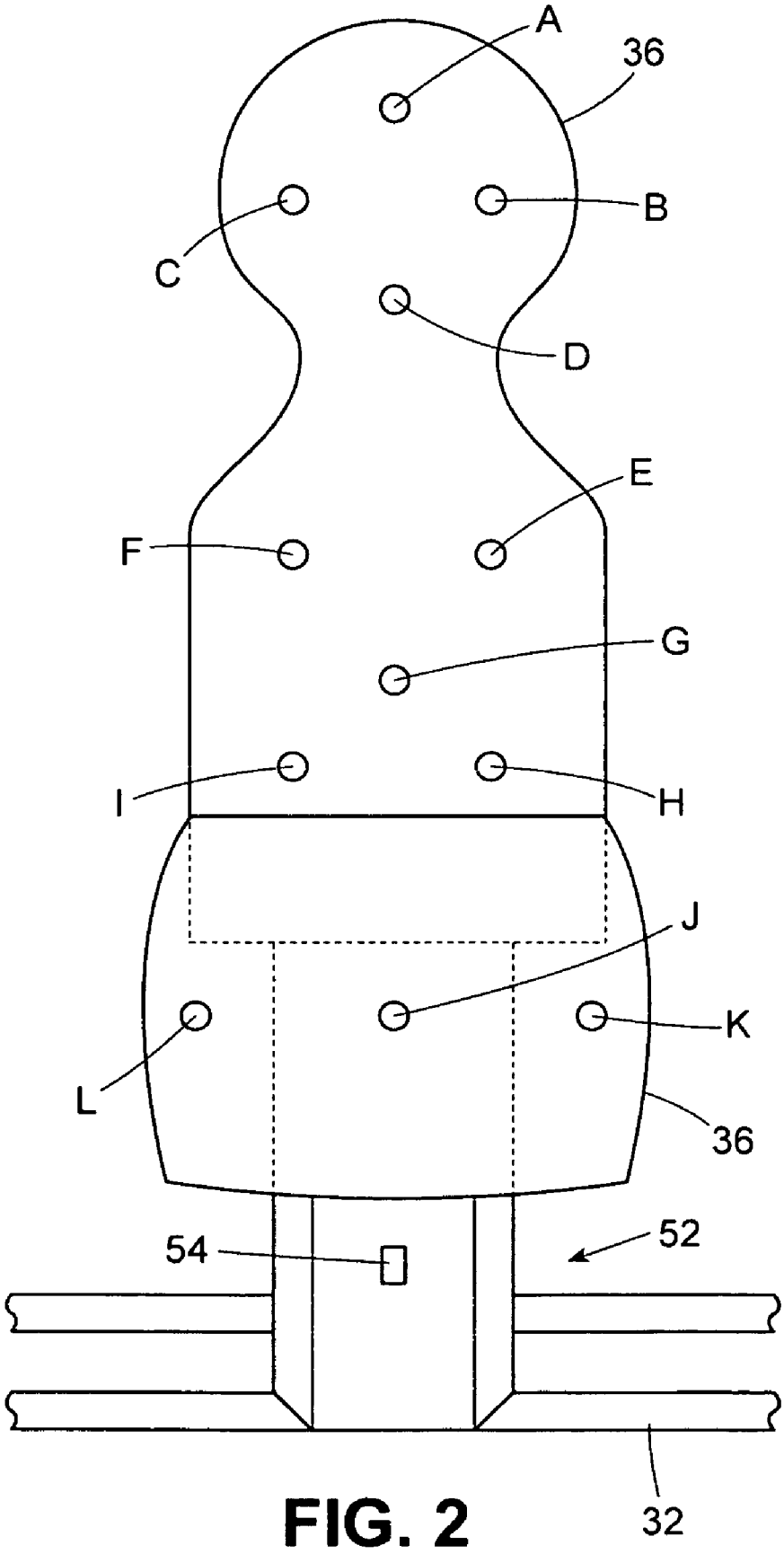
FIG. 2 is a close-up view of the impact receiving body of the interactive virtual personal trainer system of FIG. 1 according to various embodiments.

Referring to FIG. 2, a close-up view of the impact receiving body 36 is shown. The impact receiving body 36 can include a padded member that can simulate the density, shape, weight, and other characteristics of an adversary or opponent. According to various embodiments, the impact receiving body 36 can have any shape that can receive the striking impacts associated with boxing, karate, kick-boxing, and other strike related techniques, such as, for example, those related to self-defense and/or the martial arts. Alternatively, the impact body can be a wall, bag, cylinder, pole, desk or any other shape or arrangement that presents a surface to be contacted by an impact force. It also may include the sensors and illuminable members disclosed there for contact to demonstrate the following of a particular sequence without requiring excessive or high impact force loads so that the device can be used to assist in testing or exercising the user's memory or ability to follow instructions. Thus, the device can be utilized in a wide variety of training or exercising routines and applications.

The impact receiving body 36 can be made of one or more parts or sections. For example, as shown in the cross-sectional view of FIG. 3, the impact receiving body 36 can be made up of any number of separately molded or formed components such as anterior torso 201 and posterior torso 202, which are joined together. Each of anterior torso 201 and posterior torso 202 can incorporate different physical properties as required by its function and/or location. The impact receiving body 36 can include an optional bottom portion 36' as shown in FIG. 2 that is arranged as a separately removable section of the impact receiving body 36.

Figure 4:
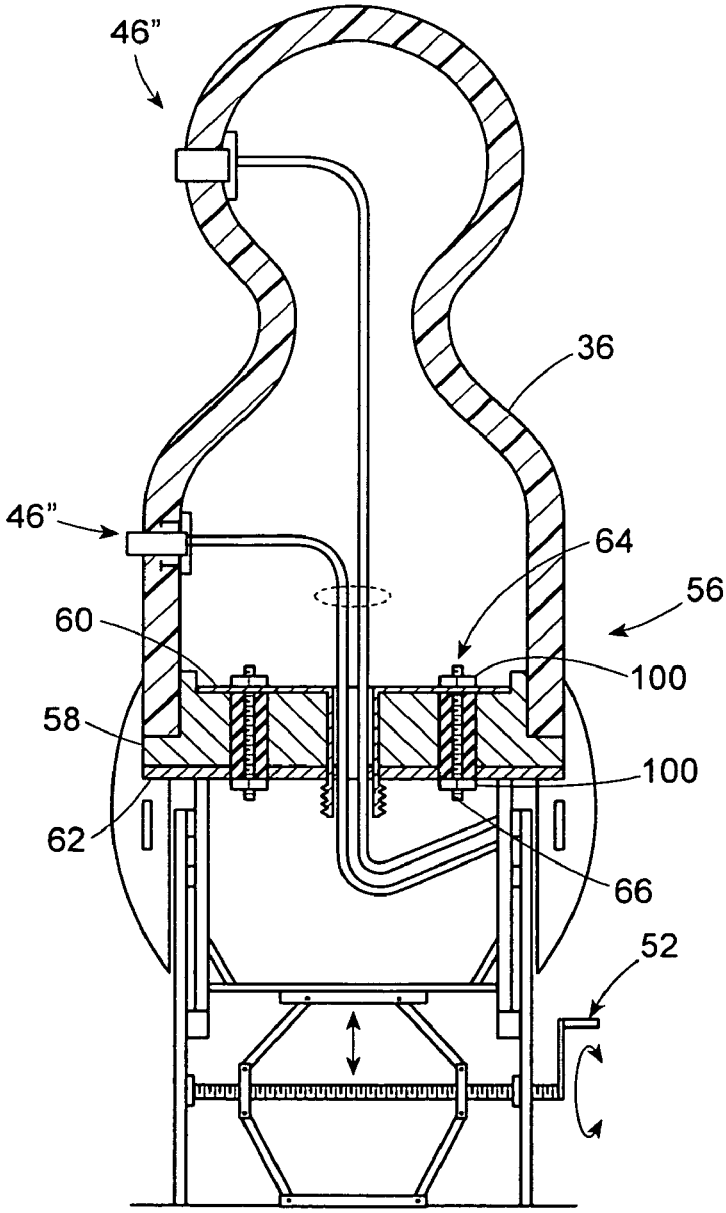
FIG. 4 is a cross-sectional side view of another embodiment of an impact receiving body.

The impact receiving body 36 can be attached to support arm 53, joined to posterior torso 202. Support arm 53 can extend downwards and be connected to support stand 32. A height-adjusting mechanism 55 can be incorporated into support arm 53 to allow impact receiving body 36 to be positioned at an appropriate height as desired by a user. In another embodiment, the height-adjusting mechanism can be a mechanical arrangement having a hand crank 52 for adjusting the height of the impact receiving body 36, as shown in FIG. 4. The height-adjusting mechanism can also be an electromechanical device that automatically controls of the height of the impact receiving body 36 by way of one or more buttons. The height of the impact receiving body 36 can be adjusted depending upon, for example, the physical characteristics of the user, the type of workout being performed, the desired physical characteristics of a virtual adversary, and the like. The height-adjusting mechanism can be provided with a height indicator and/or a memory setting.

An auto-shutoff mechanism 54 can be provided that can be operable to shut down operation of the interactive virtual personal trainer system 30 upon sensing an unstable operation condition. The auto-shutoff mechanism 54 could be arranged in a user-accessible location so as to be readily actuatable by the user under an emergency condition or under any other condition where a pause or termination of the workout is desirable. When physical parameter monitoring of the user is included, the auto-shutoff can be engaged upon detection of a physical parameter that is outside of a safe range for the particular user.

According to various embodiments, one or more impact sensors 46 can be arranged in various locations on the surface of the impact receiving body 36, as shown at A through K, in FIG. 2. Each of the impact sensors 46 can be arranged to register information about impact responses as they are received such as, for example, response time and strength of impact. The locations of the impact sensors 46 can correspond to strategic strike zones of a virtual opponent, such as a human-like adversary. According to various embodiments, the number, position, and size of the impact sensors 46 can vary without departing from the scope of the present teachings.

According to various embodiments, one or more indicators, such as light assemblies or other types of user-perceivable indicators, such as an audio speaker, can be mounted at various locations on the surface of the impact receiving body 36. Each of the plurality of indicators can be arranged adjacent to a corresponding impact sensor 46. According to various embodiments, each of the plurality of indicators can be mated with a corresponding impact sensor 46 to form an illuminable impact sensor that can be installed as a unit on the impact receiving body 36.

Referring to FIG. 4, a side-view cross-section through one embodiment of an impact receiving body 36 is illustrated. The impact receiving body 36 shown in FIG. 4 has been simplified in order to schematically show the interior of the impact receiving body 36. One illuminable impact sensor 46" is shown arranged in a head area thereof and a second illuminable impact sensor 46''' is shown in the torso area.

According to various embodiments, the impact receiving body 36 can be a hollow body. The material, wall thickness, and density of the impact receiving body 36 can be designed to provide variable impact resistances that can be optimized to particular types of fitness workouts and different types of users. For example, the impact receiving body 36 can be made from a plastic, such as, for example, a polyurethane material. Moreover, the impact receiving body 36 can be provided with a coating to optimize the characteristics of the impact receiving body 36, such as, for example, durability, softness, resilience, and the like. At different areas on the impact receiving body 36, the wall thickness, the coating thickness, and the materials used for each can be varied to achieve different impact resistance and oscillation damping characteristics.

As shown in FIG. 4, in another embodiment the impact receiving body 36 can be optionally connected to a damping control mechanism 56. The damping control mechanism 56 can operate to adjustably control the stiffness and rigidity of the impact receiving body 36. The damping control mechanism 56 can include a housing base 58 to which the impact receiving body 36 is attached. The impact receiving body 36 can be adhered to the housing base 58, for example, by way of a glue, such as a polyurethane adhesive. The housing base 58 can be sandwiched between metal plates 60, 62. The lower metal plate 62 can be arranged to operatively connect and support the impact receiving body 36 to the height adjusting mechanism 52.

Figure 5:
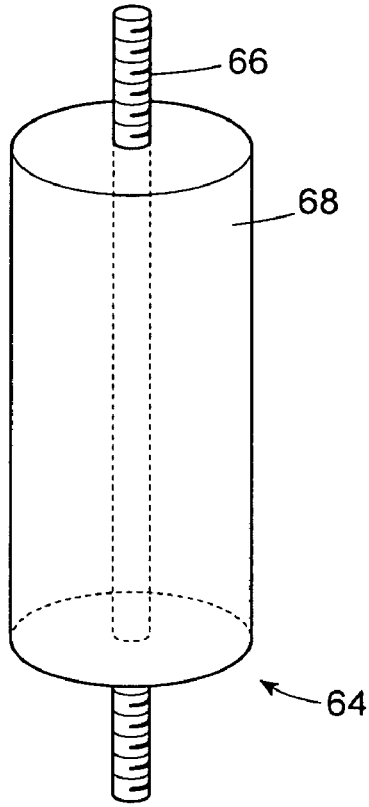
FIG. 5 illustrates a portion of a damper unit according to various embodiments.

One or more damper units 64 can be arranged to vary the damping characteristics of the impact receiving body 36. Each damper unit 64 can be arranged to force the metal plates 60, 62 towards one another. Referring to FIG. 5, a portion of a damper unit 64 is shown. A damper unit 64 can include a shaft 66 and a damper 68 that can be guided on the shaft 66. The shaft 66 can be threaded such that it can threadingly engage the damper 68. The damper 68 can be made of a resilient material, such as, for example, rubber. As shown in FIG. 4, the respective ends of the threaded shaft 66 can extend through each of the metal plates 60, 62. Nuts 100 can be threaded onto each of the ends of the threaded shaft 66.

To adjust the amount of damping, the damping control mechanism 56 can be adjusted. For example, additional damper subassemblies 64 can be added to increase the amount of damping. Furthermore, the amount of damping can be adjusted by tightening or loosening the nuts 100 of each damper unit 64. As a result, the amount of damping can be adjusted in a wide-range from a relatively small amount of damping at one end of the range, for a child user, to a relatively large amount of damping, for an extremely strong adult, at the other end of the range.

Each of the illuminable impact sensors 46", 46'" can be arranged to extend through the thickness of the impact receiving body 36 such that one end thereof is visible to the user. At the surface of the impact receiving body 36, the impact sensors 46', 46'" can emit a user-perceivable signal, such as a light signal, that prompts the user to perform an impact-dependent response on the impact receiving body 36 in the vicinity of the illuminated impact sensor. Within the impact receiving body 36, wires and tubes extending from each of the illuminable impact sensor subassemblies 46", 46'" can be bundled and directed to the control unit 40. The control unit 40 can send signals to and receive signals from each of the illuminable impact sensor subassemblies 46", 46'".

Figure 3:
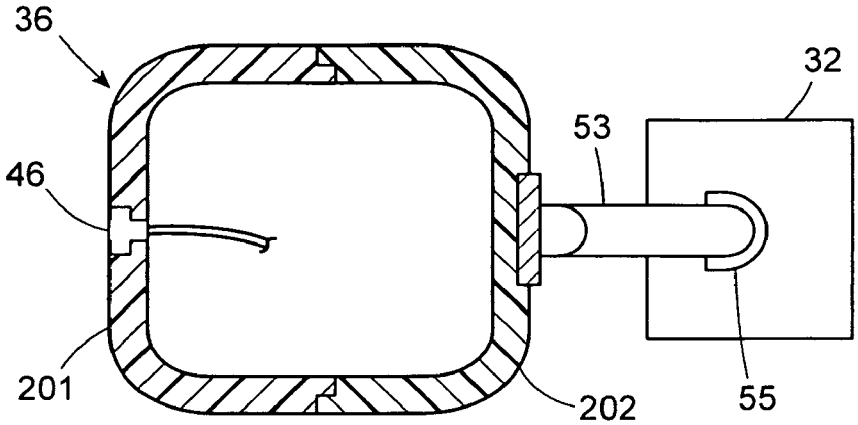
FIG. 3 is a cross-sectional overhead view of the impact receiving body shown in FIG. 2.
Figure 6:
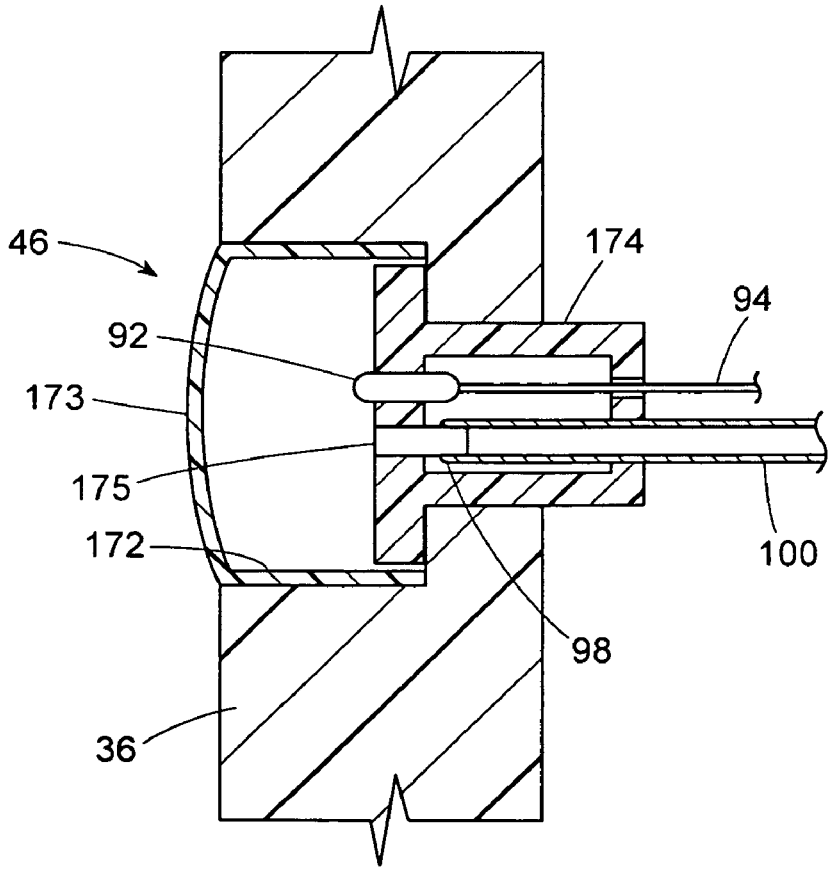
FIG. 6 is a cross-sectional view through an illuminable impact sensor positioned in an impact receiving body.

Referring to FIG. 6, a detailed view of an illuminable impact sensor 46 of the type shown in FIGS. 2 and 3 is illustrated. The illuminable impact sensor 46 can include a plunger housing 172 that can compress or deform upon impact. The plunger housing 172 can be cup-shaped in form and made from a transparent or semi-transparent resilient material such as, for example, silicon rubber. The closed end 173 of the plunger housing may have a convex shaped impact surface. The plunger housing 172 can be arranged to be inset into the wall of the impact receiving body 36 so that the convex surface of the closed-end 173 protrudes slightly from an outer surface of the impact receiving body 36.

As shown in FIG. 6, an open end of the plunger housing 172 can contact a mounting plate 174 inset into the wall of the impact receiving body 36. The mounting plate 174 can be formed of a rigid material such as, for example, rubber or plastic. The mounting plate 174 can include one or more apertures for securing indicators such as, for example, illumination device 92. Illumination device 92 may be a light-emitting-diode (LED). Lead wires 94 extending from the illumination device 92 can be directed through the one or more apertures for connection to the control unit 40. To provide the user with a variety of user-perceivable signals, each illumination device 92 can be arranged to emit a different color. For example, different colored LEDs or LEDs capable of emitting different colors, can be provided in each aperture.

The mounting plate 174 can include one or more outlet air apertures 175 that can be arranged to direct air out of the plunger housing 172. Air can be forced out of the plunger housing 172 through the one or more outlet air apertures 175 whenever the plunger housing 172 is compressed or deformed by an impact inflicted by the user. A tube extension 98 onto which an air hose 100 can be secured, may be inset into the outlet air aperture 175. The air hose 100 can be arranged to direct air to an impact measurement device 150, shown in FIG. 10 and described below.

Figure 7:
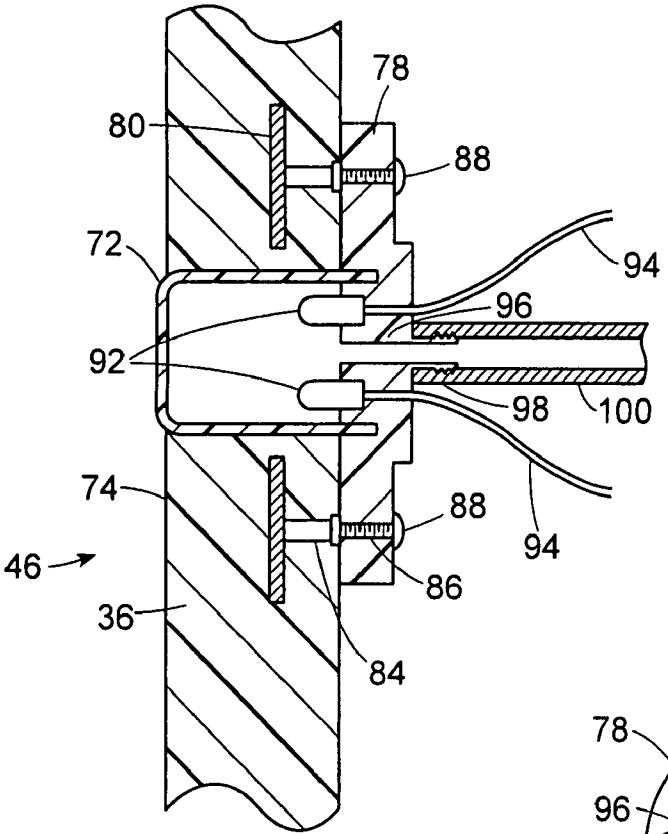
FIG. 7 is an enlarged cross-sectional view of another embodiment of an illuminable impact sensor.

Referring to FIG. 7, a cross-section of an illuminable impact sensor 46 of an alternative embodiment is illustrated. The illuminable impact sensor 46 can include a plunger housing 72 that can compress upon impact. The plunger housing 72 can be made from a transparent or semi-transparent resilient material, such as, for example, silicon rubber. The plunger housing 72 can include a cup-shape such that a closed-end of the plunger housing 72 can be arranged to be relatively flush with an outer surface 74 of the impact receiving body 36, as shown in FIG. 7.

Figure 9:
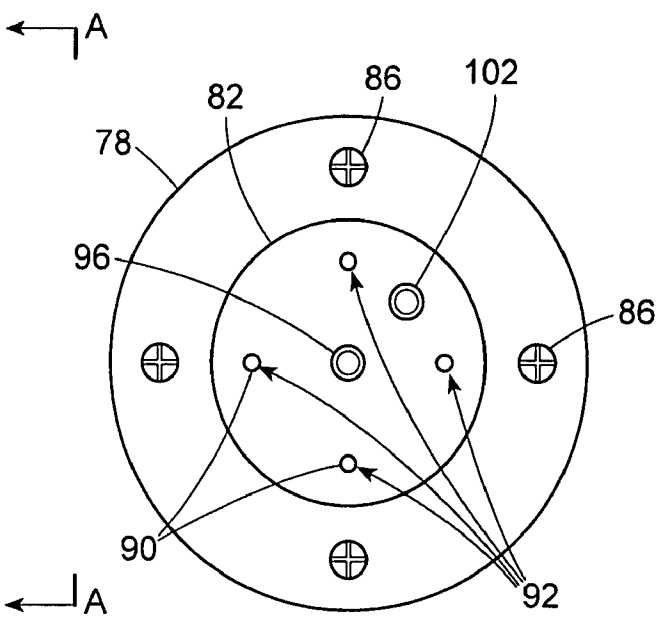
FIG. 9 is an end view of the mounting plate of the illuminable impact sensor shown in FIG. 7.
Figure 8:
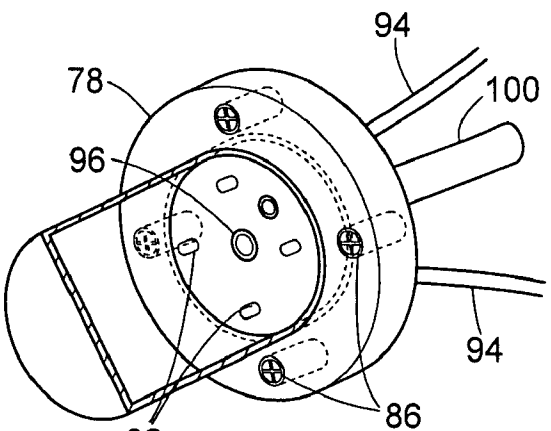
FIG. 8 is a perspective view of a plunger housing and a mounting plate of the illuminable impact sensor shown in FIG. 7.

As shown in FIGS. 7, 8, and 9, an open end of the plunger housing 72 can be arranged to be secured to a mounting plate 78. The plunger housing 72 can be arranged to fit into and become secured within a circular groove 82 formed in the mounting plate 78 in an air-tight manner. For example, the plunger housing 72 can be secured to the mounting plate 78 by way of an adhesive, a friction fit, a screw, and the like. The mounting plate 78 can be made of a rigid material, such as, for example, a plastic.

As shown in FIG. 7, to attach the mounting plate 78 to the impact receiving body 36, a retaining ring 80 can be arranged in the wall of the impact receiving body 36. The retaining ring 80 can be made of a rigid material having a high melting temperature, such as, for example, metal. The retaining ring 80 can be in the shape of a disc or donut that can be arranged to circumferentially surround the plunger housing 72. The metal retaining ring 80 can be placed in the wall of the impact receiving body 36 during manufacture and secured within the wall.

As shown in FIG. 7, at circumferentially spaced intervals, the metal retaining ring 80 can include one or more laterally protruding studs 84. The studs 84 can be arranged with a bore formed therein for receiving a screw or bolt 88, or similar securing mechanism. Referring to FIGS. 8 and 9, the mounting plate 78 can be formed with one or more holes 86 at locations corresponding to the one or more laterally protruding studs 84 of the metal retaining ring 80. The mounting plate 78 can be secured to the metal retaining ring 80 by way of one or more screws, bolts, or similar securing mechanisms 88. The mounting plate 78 and the metal retaining ring 80 can securely support the illuminable impact sensor 46 on the impact receiving body 36. The arrangement of the mounting plate 78 and the metal retaining ring 80 can operate to disperse the force of impact responses received by the illuminable impact sensor 46.

The mounting plate 78 can include one or more apertures 90 for securing indicators, such as, for example, illumination devices 92, within the plunger housing 72. As shown in FIGS. 7 and 8, the illumination devices 92 can include light-emitting-diodes (LEDs). Lead wires 94 extending from the LEDs 92 can be directed through the one or more apertures 90 for connection to the control unit 40. To provide the user with a variety of user-perceivable signals, each indicator 92 can be arranged to emit a different color. For example, different colored LEDs or LEDs capable of emitting different colors, can be provided in each aperture 90.

The mounting plate 78 can include one or more outlet apertures 96 that can be arranged to direct a fluid out of the plunger housing 72. Any fluid can be used depending upon the specific arrangement of the device and the hose connecting the impact sensor and the plunger housing can be filled with fluid to facilitate operation. The most preferred fluid is air, as it is readily available and fills any open spaces in the device lines or hoses. Air can be forced out of the plunger housing 72 through the one or more outlet air apertures 96 whenever the plunger housing 72 is compressed by an impact inflicted by the user. As shown in FIGS. 7, 8, and 9, the mounting plate 78 is shown provided with one outlet air aperture 96. The outlet air aperture 96 can include a tube extension 98 onto which an air hose 100 can be secured. The air hose 100 can be arranged to direct air to an impact measurement device 150, shown in FIG. 10 and described below.

Referring to FIG. 9, the mounting plate 78 can include one or more check valves 102. The check valves 102 can be arranged to allow the fluid or air to flow back into the plunger housing 72 after the plunger housing 72 has been impacted. After being impacted, the resilient plunger housing 72 can expand back into its original shape, producing a low pressure within the plunger housing 72 and sucking air into the plunger housing through the check valve 102. At this point, the illuminable impact sensor 46 is ready to be illuminated and impacted again.

Figure 10:
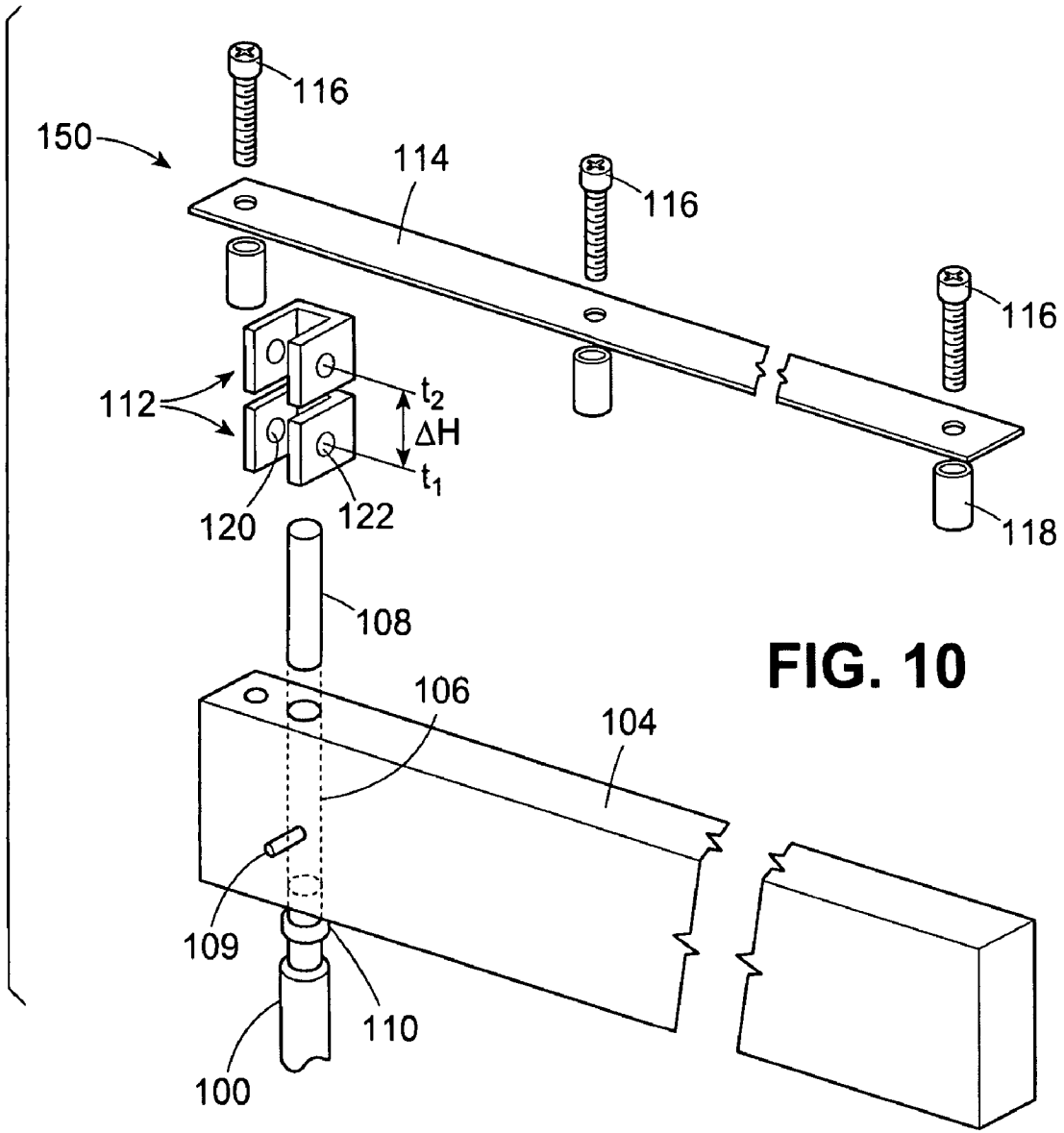
FIG. 10 is an exploded view of an impact detector device according to various embodiments.

Referring to FIG. 10, an impact measurement device 150 for detecting and measuring characteristics of the impact-responses of the user is illustrated. The impact measurement device 150 of FIG. 10 can detect and measure responses from an impact sensor such as illuminable impact sensor 46 arranged on the impact receiving body 36. However, to more clearly illustrate and describe the structure and operation of the impact measurement device 150, the structure and operation of the impact measurement device 150 will be disclosed with respect to responses received from one or two impact sensors 46.

As shown in FIG. 10, the impact measurement device 150 can include a cylinder block 104 having one or more passages or cylinders 106 formed therein. Within each cylinder 106, a piston 108 can be arranged to freely reciprocate and then return to its original position by gravity. The piston 108 can be made from various types of metallic and non-metallic materials. For example, the piston 108 can be made from brass or nylon with the specific material selected based on the fluid used and the size of the device. A skilled artisan can conduct routine tests to determine which material works best for a particular arrangement of the device.

At one end of the cylinder block 104 and in fluid communication with each cylinder 106, a hose-in connector 110 can be arranged. The air hose 100 from an impact sensor 46 can be secured onto the hose-in connector 110 such that air pressure within the hose can be used to force the piston 108 upwardly against the force of gravity. The size, shape, and material of the piston 108 can be varied to change the amount of force needed to move the piston 108 vertically in the cylinder. Pistons 108 can be interchanged depending on the characteristics of the user, such as, for example, a child, adult, athlete, and the like. A dust escape hole 109 can be arranged in the cylinder block 104 in fluid communication with the cylinder 106 to allow entrained dust to be removed from the cylinder 106 during use.

Figure 11:
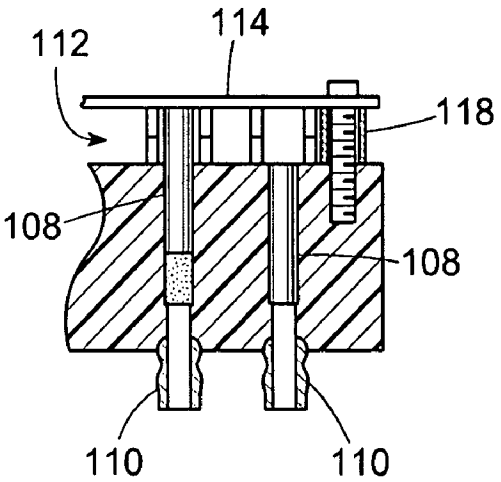
FIG. 11 is an enlarged cross-sectional view of two piston and cylinder subassemblies of the impact detector device shown in FIG. 10 according to various embodiments.

At the other end of the cylinder block 104 and in the vicinity of the cylinder openings, one or more detecting devices 112 can be arranged. The detecting device 112 can be secured to or adjacent to the cylinder block 104 by way of a bracket 114 and a plurality of hold-down screws 116. A spacer 118 can be used to surround each hold-down screw 116. As shown in FIG. 11, two stacked detecting devices 112 can be sandwiched between the bracket 114 and the cylinder block 104. More than two detecting devices 112 can be arranged in a stacked arrangement depending upon the desired number and range of readings to be detected for each impact sensor 46. According to various embodiments, the detecting device 112 can be a photodiode.

In operation, the photodiode of detecting device 112 can continuously send a light signal between a light emitter side 120 and a light receiver side 122. Whenever the light signal is interrupted such as, for example, by a piston 108 that has been forced upwardly, the light receiver 122 is prevented from receiving a light signal. Under this interrupted condition, the detecting device 112 can be arranged to output a responsive signal to the control unit 40 indicating that a piston 108 has at least reached the height of that detecting device 112. It is anticipated that other types of detecting devices 112 other than a photodiode may also be incorporated to indicate the position of piston 108.

Figure 12:
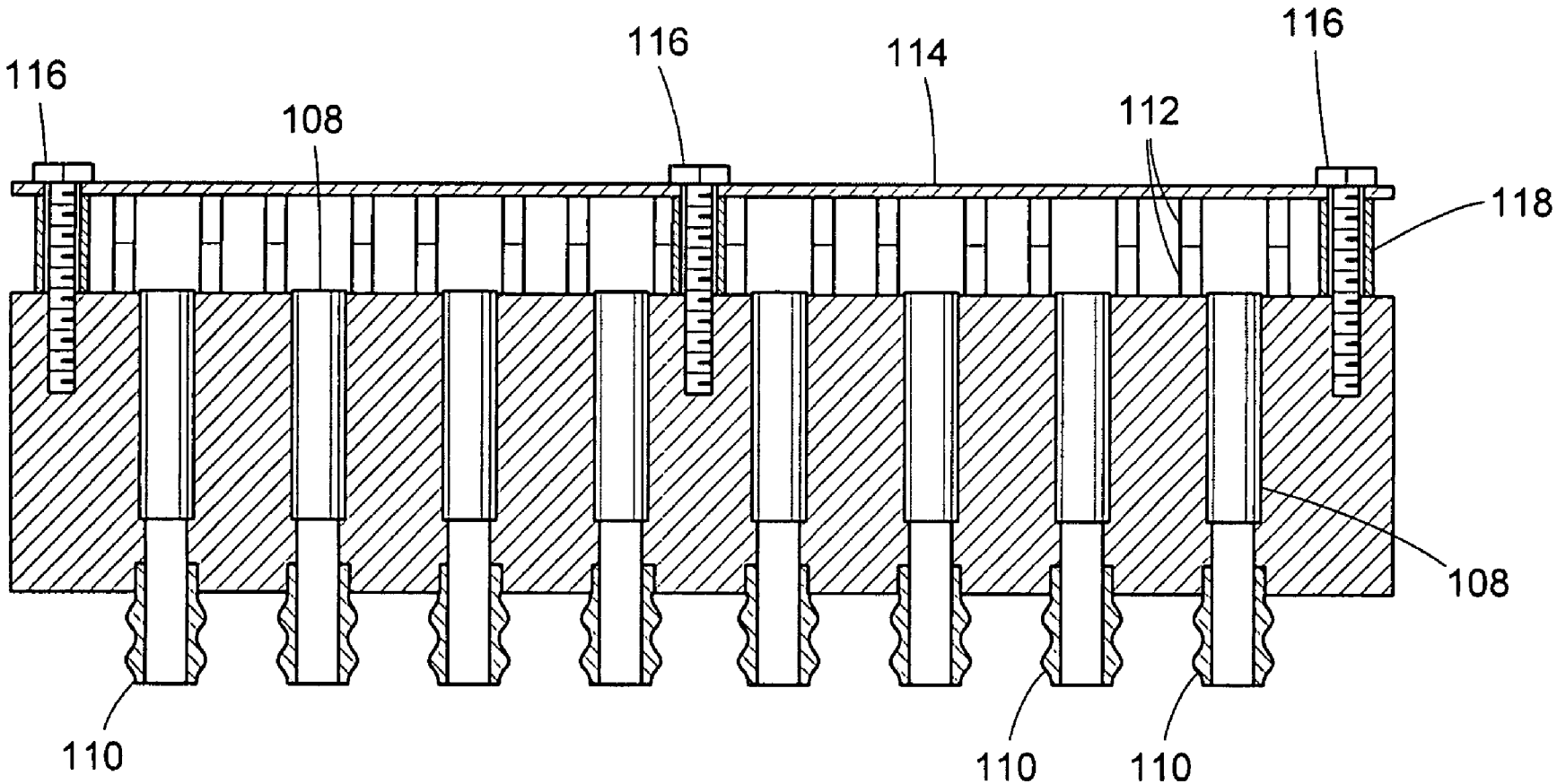
FIG. 12 is a cross-sectional view of a plurality of piston and cylinder subassemblies of the impact detector device according to various embodiments.

Referring to FIGS. 11 and 12, two neighboring piston and cylinder arrangements of the impact measurement device 150 are shown. The right-side portion of FIG. 11 shows a piston 108 in a non-actuated state while the left-side portion of FIG. 11 shows a piston 108 in a fully-actuated state. In the non-actuated state, the piston 108 rests on a bottom edge of the cylinder 106 and does not interrupt any of the light signals sent by the photodiodes of detecting devices 112. When forced upwardly by a compressed air pulse created by an impact, the piston 108 operates to interrupt the one or more light signals, triggering the one or more photodiodes of detecting devices 112 to output a responsive signal.

By obtaining readings from the detecting devices 112, various characteristics of the requested impact responses, or lack of impact responses, can be analyzed by the control unit 40 and fed back to the user. When the initial movement of the piston is detected, this indicates the user's initial reaction time to the first signal of the sequences provided by the program or routine. By stacking two or more detecting devices 112, the distance of travel of each piston 108 can be detected by sensing the number of detecting devices 112 in each stack that has been tripped. Such a reading can allow the applied force or strength and accuracy of the impact inflicted by the user to be determined because the length of travel of the piston 108 is related to the applied force, strength and accuracy of the impact. The stronger and more precise the impact directed to an impact sensor 46, the larger the pressure pulse that is fed through the air hose 100 to the impact measurement device 150. This enables the accuracy and force of the impact to be determined.

Moreover, a response time to a user-perceivable prompt can be measured by obtaining readings from the detecting devices 112. For example, the control unit 40 can include a running clock module. The clock module can provide time data corresponding to the time that a user-perceivable signal is sent to an impact sensor 46. The control unit 40 can be arranged to subsequently wait a pre-set period of time for a response signal from one or more of the detecting devices 112. If response signals are obtained from one or more of the detecting devices 112 within the pre-set period of time, the control unit 40 can store the time data of these responsive signals. The time difference between the time readings can be used to determine reaction times for the user.

The impact measurement device 150 can be securely housed and supported on any portion of the interactive virtual personal trainer system 30. Each detecting device 112 can be operatively connected to the control unit 40 to send readings for processing at the control unit 40, as will be described with respect to FIG. 13.

Figure 13:
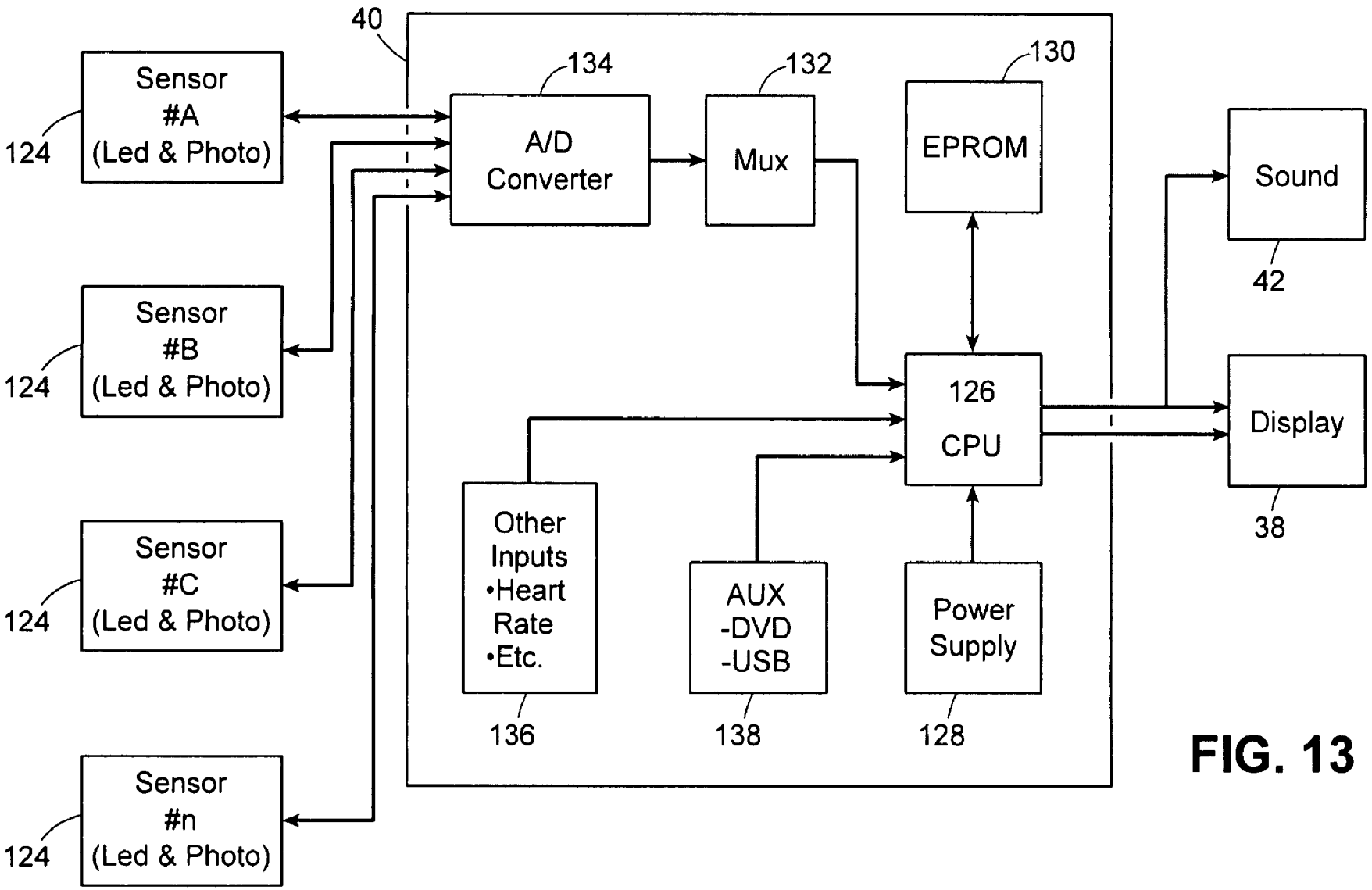
FIG. 13 is a schematic diagram showing the overall control system of the interactive virtual personal trainer system according to various embodiments.

Referring to FIG. 13, an overall block diagram of the control system for the interactive virtual personal trainer system 30 is shown. The control unit 40 is arranged in operative communication with a plurality of impact detector assemblies 124, numbered A, B, C, . . . n, wherein each impact detector assembly 124 comprises an illuminable impact sensor 46 and a corresponding piston, cylinder, and sensor arrangement of the impact measurement device 150. For example, the number of impact detector assemblies 124 corresponds to the number of illuminable impact sensor subassemblies, A-K, arranged on the impact receiving body 36, as shown in FIG. 2. Referring to FIG. 13, the control unit 40 is arranged in operative communication with the one or more video monitors 38 and the one or more speaker units 42. The control unit 40 can be arranged to control the audiovisual workout instructions being broadcast to the user in response to the quality of impact responses imparted to the impact detector assemblies 124.

As shown in FIG. 13, the control unit 40 can include a central processing unit (CPU) 126 that can operate to interpret and execute instructions during operation. The CPU 126 can be powered by a power supply 128 that can be arranged to also supply power to other portions of the system 30. The power supply 128 can include a 120-volt power supply or a self-contained battery pack.

An erasable programmable memory (EPROM) 130 can be arranged in operative contact with the CPU 126. The EPROM 130 can store firmware and software programs retrieved by the CPU during operation to control the operation of the system 30. The EPROM 130 can be used to store the workout results of one or more users for retrieval and use later. For example, the data stored in the EPROM 130 can be used to track and compare the progress of a user's skills and endurance against the results of other users.

Programs can be loaded into the EPROM 130 and into the CPU 126 through an auxiliary device 138. The auxiliary device 138 can be a recordable media drive, such as, for example, a DVD-ROM drive. The recordable media drive can be arranged in a user-accessible location such that different workout programs can be loaded by the user and/or selectively retrieved by the CPU during the course of a workout. The recordable media drive can be arranged to have read/write capabilities.

The control unit 40 can include an analog-to-digital converter 134 for receiving and sending signals from each of the impact detector assemblies 124. A multiplexer (MUX) 132 can be arranged between the analog-to-digital converter 134 and the CPU 126. The MUX 132 can be arranged to sort information retrieved from the impact detector assemblies 124 for use by the CPU 126. The control unit 40 can also include a clock module (not shown).

Various other input devices 136 can be operatively arranged with the CPU 126. For example, the CPU 126 can be arranged to receive data from a user by way of a heart rate monitor, a balance sensor, and the footwork position sensors 50 arranged on the mat 41, as discussed with respect to FIG. 1.

Figure 14:
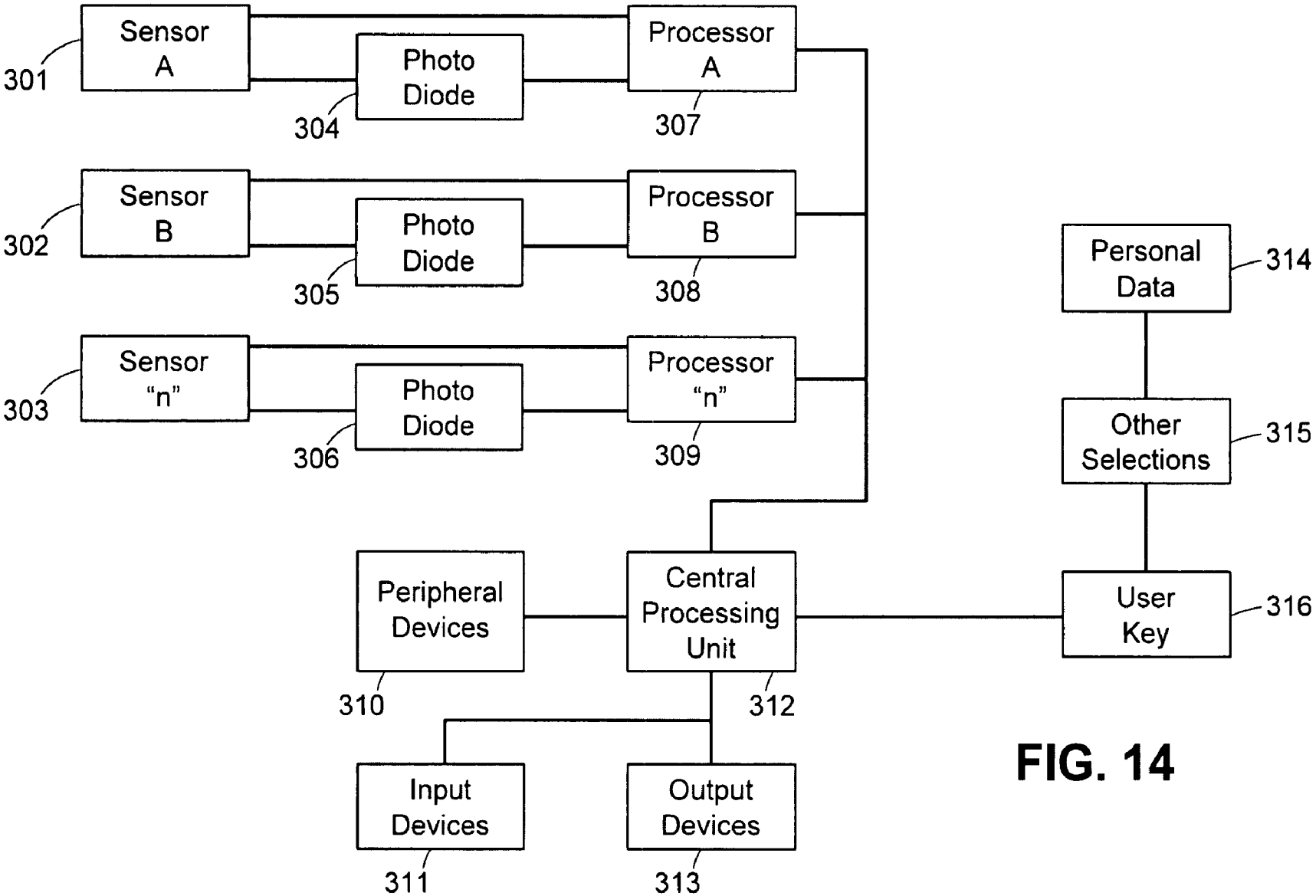
FIG. 14 is a schematic diagram showing the overall control system of the interactive virtual personal trainer system according to various embodiments, and also shows a flow of information between a number of impact detector assemblies and the control system.

Referring to FIG. 14, another overall block diagram of the control system for the interactive virtual personal trainer system 30 is shown. The overall block diagram of FIG. 14 includes many of the same components shown in FIG. 13, as well as several additional components. There may be any number of sensors, for example sensors 301-303, as appropriate for the device. Sensors 301-303 may include an impact sensor and an LED. Processors 307-309 may be EPROM type processors in communication with sensors 301-303. Peripheral devices 310 may include DVD type devices, storage devices or any other type of peripheral devices attached to central processing unit 312. Output devices 313 may include a display screen, head sets, speakers or any other type of device to provide feedback to the user. Input devices 311 may include heart rate monitors, tilt sensors or any other type of device to provide information for the operation of the system.

FIG. 14 schematically shows the coding 314-316 of a user key for running a workout that is personalized to a user's preferences. The user key could be programmed with one or more codes depending on user preferences entered, for example, via a web page or via a questionnaire provided at the user's health club. Information such as personal data 314, variables, exercise routine selections, and any other information 315 could be entered into an input device that places the information onto a user key 316. After the user provides his preferences, the user key can be sent directly to the user or picked up at the health club. The user can then insert the user key into the interactive virtual personal trainer system 30 at which time the user key selects the pre-programmed workout to be run for the user.

According to various embodiments, user preferences can include the user's physical characteristics, such as, height, weight, strength, sex, age, and the like, the user's past workout experience, boxing level, belt color, previous experience using the virtual personal trainer system, and the like, as well as other miscellaneous considerations, such as type of music to be played during the workout. Some or all of this data could be coded directly onto the user key, or alternatively, the data could be processed to determine a scaled selection that could be coded onto the user key so that a preselected program or routine for the user is provided when engaging and accessing the device.

FIG. 14 also shows a flow of information between a number of impact detector assemblies and the control system, as will be more fully discussed with respect to FIG. 15 below.

Figure 15:
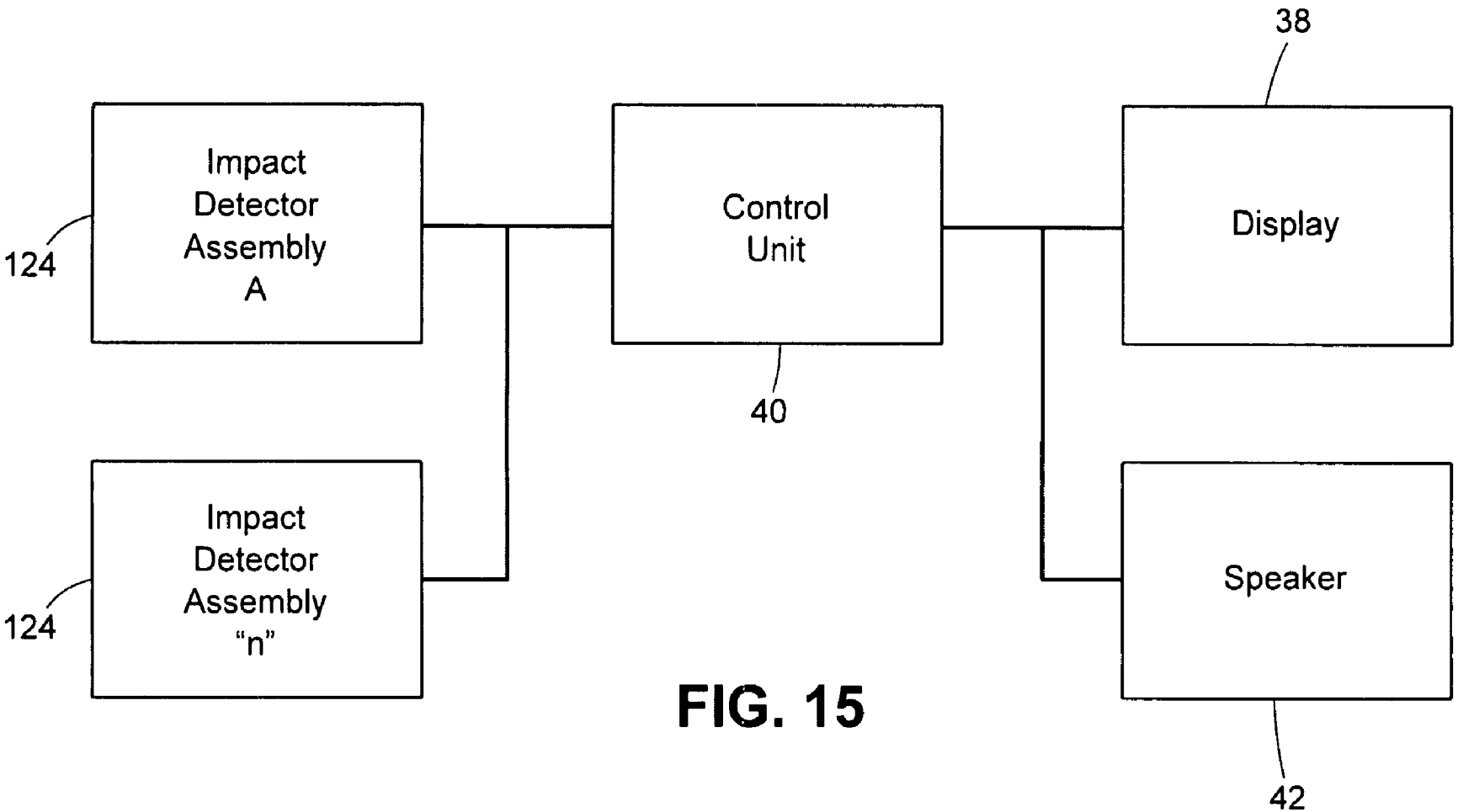
FIG. 15 is a schematic diagram showing a flow of information between a number of impact detector assemblies and the control system according to various embodiments.

Referring to FIG. 15, the flow of information between a number of impact detector assemblies 124 (A, B, C, . . . n), a control unit 40, a video monitor 38, and a speaker unit 42 is schematically shown. During a typical choreographed workout, a plurality of impact-dependent response routines can be selectively requested from the user by broadcasting audiovisual instructions through the video monitor and/or speaker units and by user-perceivable signals being sent to the one or more illuminable impact sensors 46. Each requested impact-dependent response routine can require the user to perform one or more impact responses at specific locations and in a specific order on the impact receiving body 36. For example, the user could be requested to hit a specific illuminable impact sensor 46 (for example, the sensor associated with assembly A) one or more times, or alternatively, the user could be requested to hit a combination of different illuminable impact sensors 46 in a specific order, one or more times each (for example, B, D, D, A, A). No matter what impact response or combination of impact responses is required to successfully complete a particular impact-dependent response routine while a workout program is being run, the control unit 40 can perform a series of iterative functions to request and analyze each impact response.

It is also possible to provide a memory test or other sequence following procedure or exercise for the user. This routine can be implemented without requiring the application of high impact forces—as long as the user contacts the sensor and causes any movement of the piston, the detecting device will be able to register a successful response. This can be used for memory testing or sequence following by users who are not necessarily in need of a cardiovascular workout. In such an arrangement, the impact receiving body can be a board or pole if the user is standing or even a desk with the user sitting at it and contacting the sensors as they are illuminated in sequence. For this embodiment, only one photodiode is required since the only item to be measured is a response and it is not necessary to measure the amount of force applied during the response.

When the amount of force is to be measured, such as in a cardiovascular workout, at least two detectors or detecting devices are needed. The following example illustrates how two detecting devices 112, such as, for example, two photodiodes, can be arranged in an impact detector assembly 124. However, it is contemplated that more than two sensors can be implemented in each impact detector assembly 124.

When prompting a user to perform a particular impact-dependent response routine, the control unit 40 can initially send one or more signals to the video monitor 42 and the speaker unit 42 to broadcast audiovisual workout instructions to the user. Simultaneously or soon thereafter, one or more of the illuminable impact sensors 46 can be illuminated by sending one or more signals from the control unit 40 to the corresponding impact detector assembly 124 (A, B, C, . . . n). For each impact detector assembly 124 that has an illuminated illuminable impact sensors 46, the control unit 40 can store a time value, $T_{A,1}$, $T_{B,1}$, . . . $T_{n,1}$, corresponding to the time that the impact detector assembly 124 was illuminated. The time reading can be determined by taking readings from the clock module of the control unit 40.

At this point, the control unit 40 can be programmed to wait a predetermined period of time for a responsive signal to be received from the first and second detecting devices 112 of each illuminated impact detector assembly 124.

If responsive signals are received from the first and second detecting devices 112 of each illuminated impact detector assembly 124 within the predetermined periods of time, time values, $T_{A,2}$, $T_{A,3}$, $T_{B,2}$, $T_{B,3}$, . . . $T_{n,2}$, $T_{n,3}$, can be assigned corresponding to clock readings at the times when the responsive signals were received by the control unit 40.

If responses are not received from the detecting devices 112 of each illuminated impact detector assembly 124 within predetermined periods of time, time values, $T_{A,2}$, $T_{A,3}$, $T_{B,2}$, $T_{B,3}$, . . . $T_{n,2}$, $T_{n,3}$, can be automatically assigned corresponding to the clock reading after the expiration of the predetermined periods of time. For example, requesting an impact-dependent response that includes illuminating impact detector assemblies A and C can result in the generation of the following time data: $T_{A,1}$, $T_{A,2}$, $T_{A,3}$, $T_{C,1}$, $T_{C,2}$, $T_{C,3}$.

As will be described below, the control unit 40 can analyze and store data generated during each impact-dependent response routine. The analysis and storage can include individually analyzing each impact response, determining a total response value for the impact-dependent response routine, and storing all impact-dependent response routine data generated during a complete workout.

Depending on the total response value for the requested impact-dependent response routine, a resulting feedback signal can be provided. The resulting feedback signal can include a repetition of the previous impact-responsive audiovisual instruction being broadcast to the user or the progression to a new impact-responsive audiovisual instruction, and various other combination feedback signals. For example, the measured data can be evaluated to determine user compliance with the predetermined response times and minimum applied force requirements of an exercise routine, and the feedback signal resulting from the evaluation can convey instructions to repeat the previous sequence to improve compliance, to modify the sequence by slowing it down or speeding it up to facilitate user compliance, or to provide a more challenging or complex routine to users who have successfully complied with the previous routine.

Figure 16:
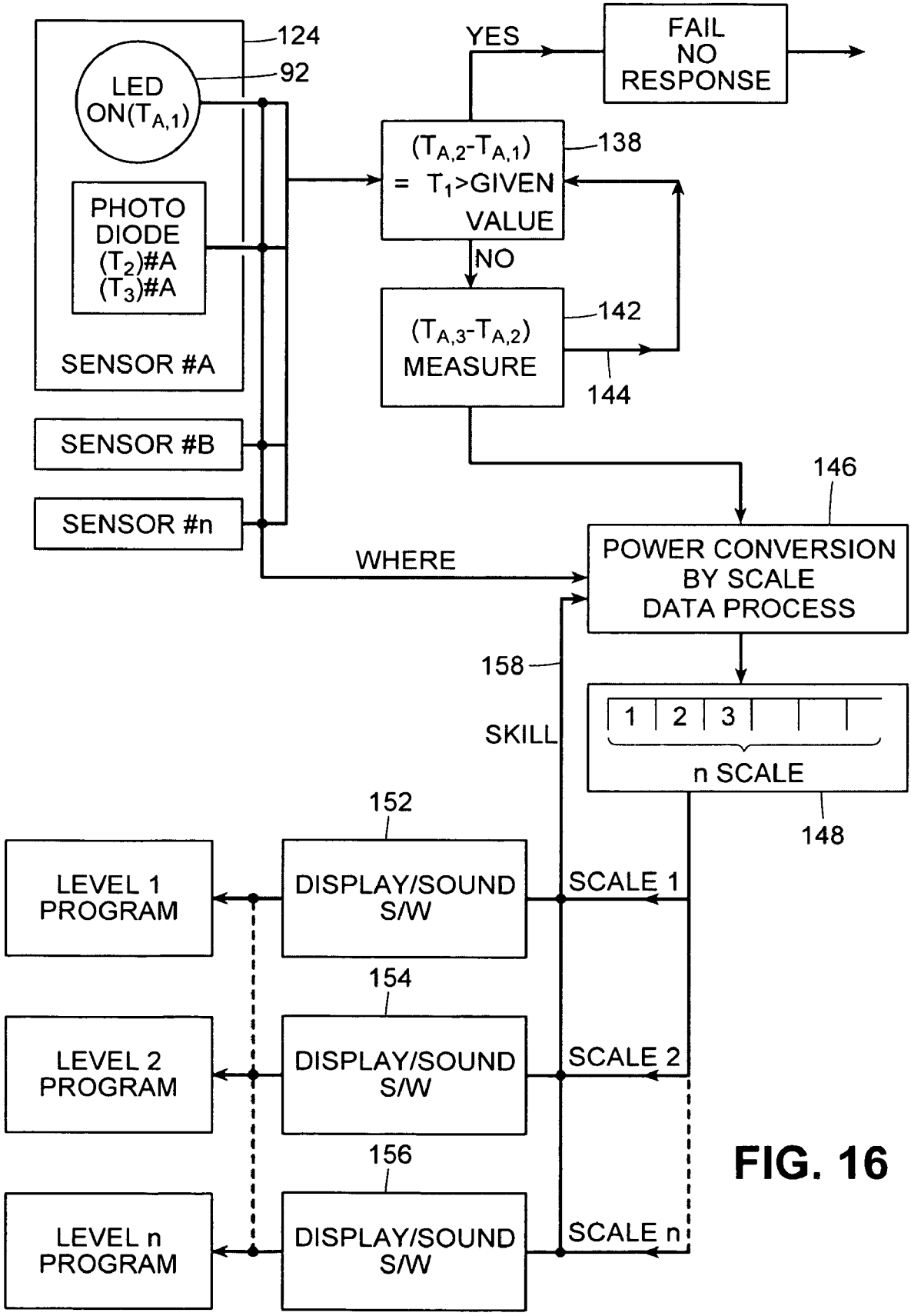
FIG. 16 is a flow chart showing the analysis of an impact-dependent response routine being performed by the control unit according to various embodiments.

Referring to FIG. 16, a flow chart shows an analysis of an impact-dependent response routine being run by the control unit 40. FIG. 16 will be referenced with respect to an impact-dependent response routine that requests a single impact response from impact detector assembly 'A', hereinafter sensor 'A'. The control unit 40 initially sends a signal to the video monitor and the speaker unit instructing the user to strike sensor 'A' once. Simultaneously or substantially simultaneously, LED 92 of sensor 'A' is illuminated to show the user where to impact the impact receiving body 36. A time value, $T_{A,1}$, is generated corresponding to a time clock reading when the LED 92 of sensor 'A' is illuminated.

A time value, $T_{A,2}$ can be generated depending upon whether or not an impact response is received at sensor 'A' within a predetermined period of time. If an impact response is not imparted to sensor 'A' within a predetermined period of time, such as, for example, 0.9999 secs, a time value $T_{A,2}$ can be automatically generated corresponding to the time clock reading after the expiration of the predetermined period of time (for example, $T_{A,1}$+0.9999). Alternatively, the time value $T_{A,2}$ can be generated corresponding to a time clock reading when a responsive signal is received by the control unit from the first photodiode of sensor 'A'. At this point, time values $T_{A,1}$ and $T_{A,2}$ can be generated from sensor 'A'.

Referring to box 138 in FIG. 16, an impact response time, $\Delta T_1$ can be determined by calculating $T_{A,2}$-$T_{A,1}$. If there is no impact response or if an impact response is received at or after the predetermined period of time, the value of $\Delta T_1$ will be greater than a preset value, and a FAIL response value can be generated at box 140. However, if the value of $\Delta T_1$ is less than a preset value, a PASS response value can be generated and the program can move to box 142.

A time value, $T_{A,3}$ can be generated depending upon whether or not an impact response is received from the second photodiode of sensor 'A' by the control unit within a second predetermined period of time. If an impact response is not received from the second photodiode within the second predetermined period of time, such as, for example, 0.001 secs, the time signal $T_{A,3}$ can be generated corresponding to the time reading on the clock after the expiration of the second predetermined period of time. Alternatively, the time value $T_{A,3}$ can be generated corresponding to a time clock reading when a responsive signal is received by the control unit from the second diode of sensor 'A'. At this point, time values $T_{A,1}$, $T_{A,2}$, $T_{A,3}$ have been generated from sensor 'A'.

Referring to box 142 in FIG. 16, a second impact response time, $\Delta T_2$ can be determined by calculating $T_{A,3}-T_{A,2}$. If there is no impact response from the second sensor, or if an impact response is received at or after the second predetermined period of time, the time difference $\Delta T_2$ will be greater than a preset value. In this case, a FAIL response value will be generated at box 142. If the time difference $\Delta T_2$ is less than a preset value, a PASS response value will be generated. At this point, the program has determined values, $T_{A,1}$, $T_{A,2}$, $T_{A,3}$, $\Delta T_1$, $\Delta T_2$ corresponding to the specific impact response measured at sensor 'A'.

If the impact-dependent response routine requires additional impact responses to be received from one or more of the impact detector assemblies 112 (sensors A, B, . . . n), the program can return to box 138 to generate additional data from those sensors, as represented by line 144. However, in this example, the impact-dependent response routine only requests an impact response from impact detector assembly 'A', and therefore, the values, $T_{A,1}$, $T_{A,2}$, $T_{A,3}$, $\Delta T_1$, $\Delta T_2$ represent all of the data that is to be generated at this juncture of the workout. After all the data is generated for the impact-dependent response routine, the program can proceed to box 146.

At box 146, the program can analyze the generated data and store calculated values in memory for use later. For example, the generated data characterizing each impact response, $T_{A,1}$, $T_{A,2}$, $T_{A,3}$, $\Delta T$, $\Delta T_2$, can be used to generate a final value for that impact response. In this example, the final value for the impact response can be represented by $IR_{A,1}$ corresponding to a first impact response imparted to sensor 'A'.

The final value of each impact response, $IR_{n,x}$, can characterize the velocity of the impact response and the response time for the impact response. The calculation of the velocity of the impact response can be based upon values corresponding to a distance between the diodes 112 of each impact detector assembly 124, $\Delta H$ (as shown in FIG. 10), and the calculated time differences, $\Delta T_1$, $\Delta T_2$. For example, the velocity of an impact response can be represented by $V=\Delta H/\Delta T_2$. After determining the velocity of an impact response, the force or strength of the impact response can be calculated, for example, by way of $F=M*A$. As a result, the strength of the impact response (related to V) and the response time of the impact response, $\Delta T_1$, are represented by the final value of each impact response, $IR_{n,x}$, After the final values, $IR_{n,x}$, for all impact responses of an impact-dependent response routine are determined, these values can be added together to obtain the final value for the impact-dependent response routine, $IRF_N$.

At box 148, the final value for the impact-dependent response routine, in this case, $IRF_1$ can be scaled by comparing the value $IRF_1$ to a range a possible values for the impact-dependent response routine. For example, the range of possible values for the impact-dependent response routine can be divided into a number of different ranges, 1, 2, . . . up to n different ranges, as shown in FIG. 16. The number of different ranges and the size thereof, can be determined by the workout program being run. The scaling can be done linearly or non-linearly depending on the workout program. The final value $IRF_1$ can be scaled by determining what range the final value $IRF_1$ falls within.

Each scale can correspond to a different impact-responsive audiovisual instruction that can be broadcast by the control unit. For example, scale 1 as shown by box 152 could correspond to commanding the control unit to broadcast to the user that his impact response was completely unsatisfactory and to repeat the previous impact-dependent response routine; scale 2 as shown by box 154 could correspond to commanding the control unit to broadcast to the user that his impact response was a little too weak and to repeat the previous impact-dependent response routine; and scale n as shown by box 156 could correspond to commanding the control unit to broadcast to the user that his impact response was very strong and to perform a new impact-dependent response routine.

As represented by line 158, the program can then return to box 146 where the generated data is analyzed and stored in memory as discussed above. The stored results of the workout can be used at the end of the workout to provide the user with an overall statistical analysis of his performance. The overall statistical analysis could include a comparison of the results of the current workout to stored results of the user, as well as other users. Statistics can be displayed, accessed, or conveyed, during or subsequent to the workout for tracking workout progress. For example, the control unit can display statistics such as workout duration, maximum impact, average impact rate, and so forth to aid the user in gauging the progress of workouts. Furthermore, the data may be communicated, such as to a remote device or computer for logging and tracking purposes.

During the analysis of an impact-dependent response routine by the control unit, the generation of PASS and FAIL response values can be used by the control unit to provide immediate feedback to the user. For example, upon receiving a PASS response value, the control unit can be programmed to send a signal to the one or more speaker units that can result in a sound, such as, for example, a grunt, groan, grunt, cry, words, and the like being broadcast through the one or more speaker units. Audio feedback can include tones, sound-effects, speech, music, and combinations thereof.

The volume of the sound can be variable depending on the response time, such as, for example, $\Delta T_1$, and the calculated strength of the impact. A relatively load grunt sound can be broadcast when the user responds fast and powerfully and a short low groan sound can be broadcast when the user responds slower with a less powerful impact. Depending on the workout program being run, the type of sound generated by the control unit can change in response to intensity, damage inflicted, workout program being run, how the impact receiving body is struck (punch, kick, elbow, etc.) and the like. Upon receiving a FAIL response, the control unit can be programmed to not send a signal to the one or more speaker units signifying to the user that the impact or lack thereof was unsatisfactory.

Figure 18:
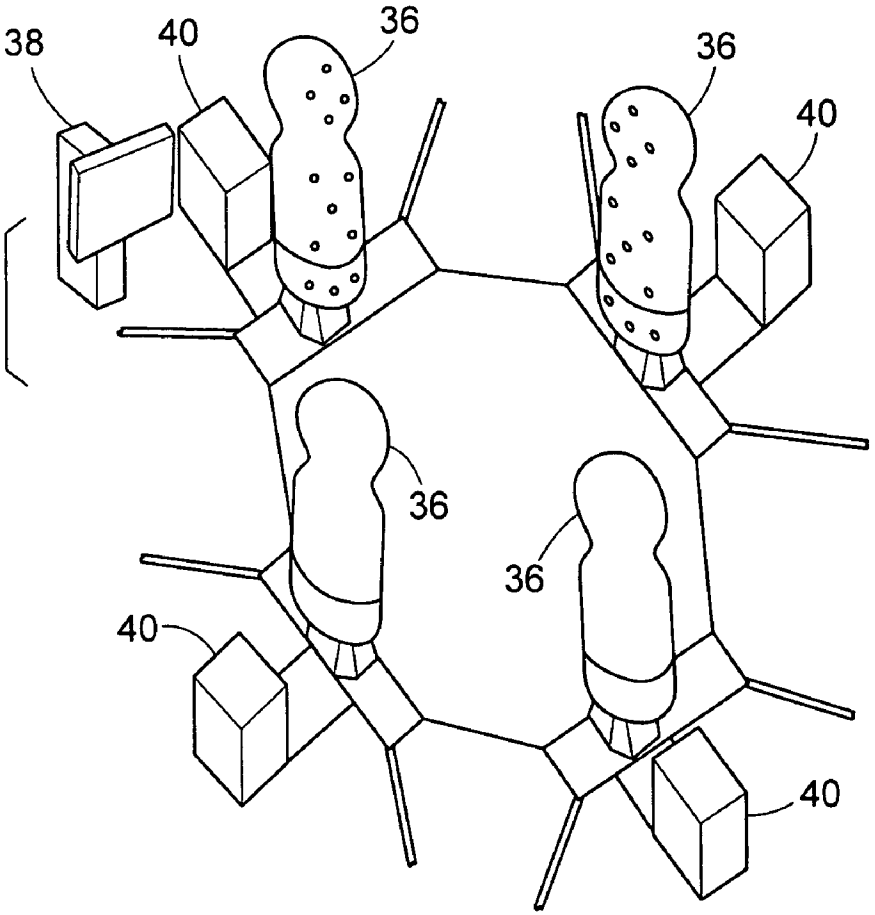
FIGS. 17 and 18 show the interactive virtual personal trainer system arranged in different tournament circuit layouts according to various embodiments.
Figure 17:
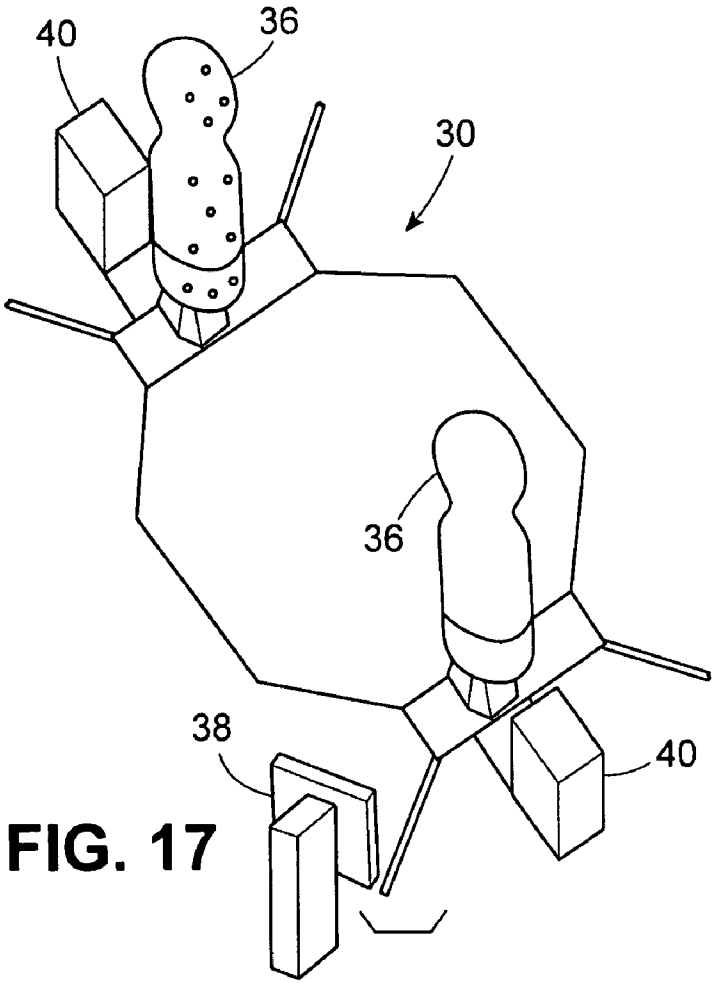
Figure 20:
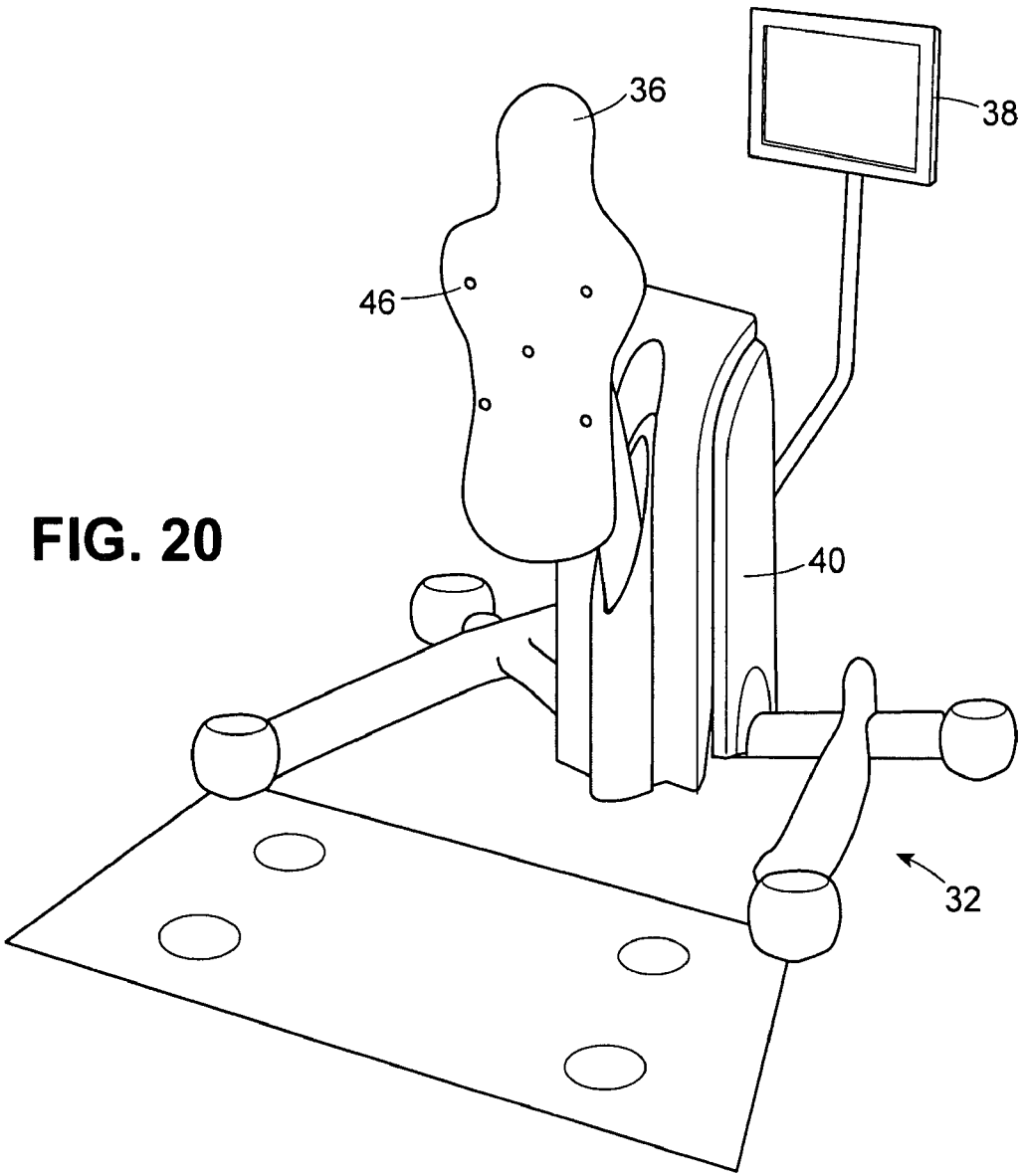
FIGS. 20-29 show the interactive virtual personal trainer system according to various embodiments.
Figure 21:
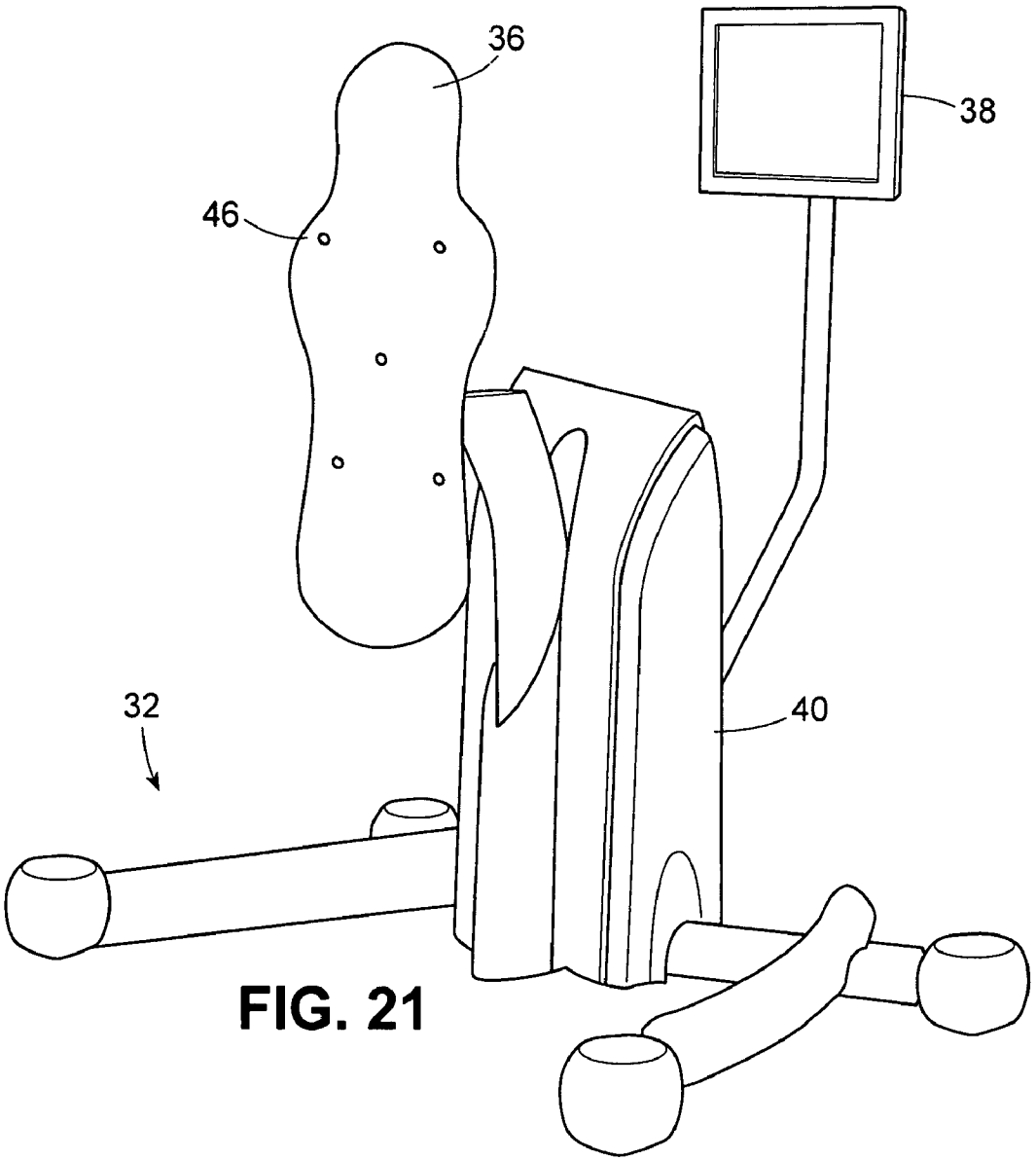
Figure 22:
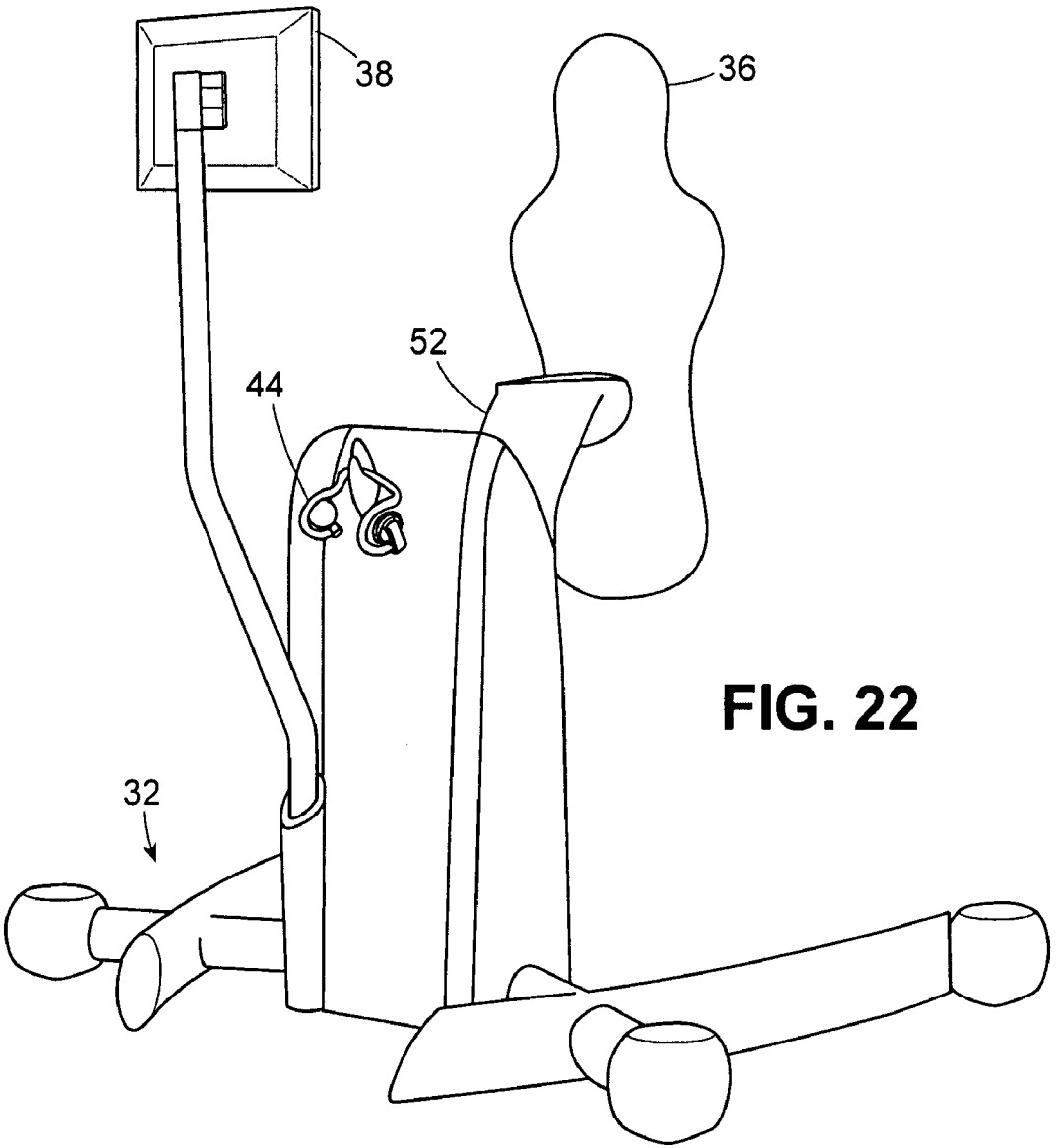
Figure 23:
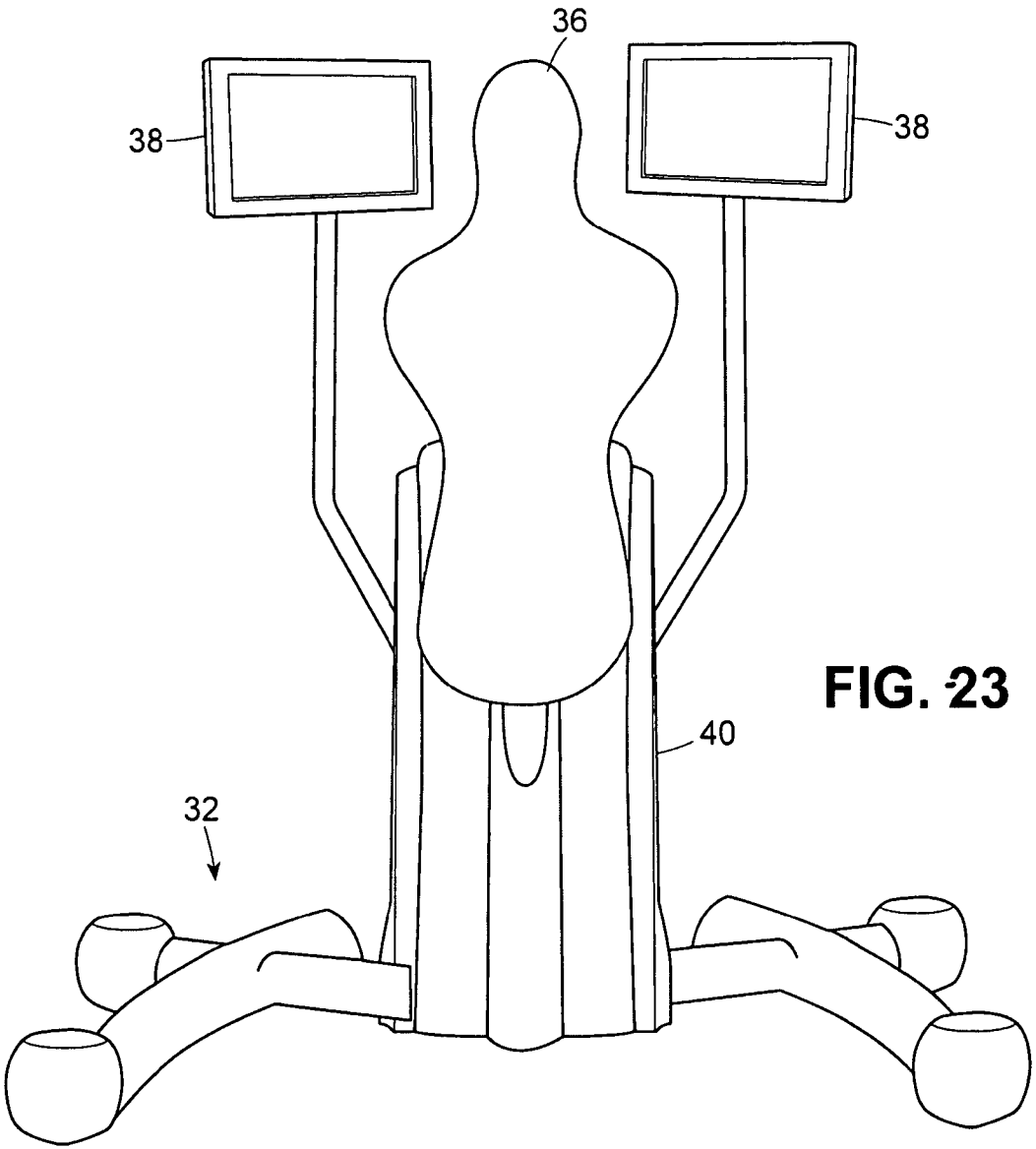
Figure 24:
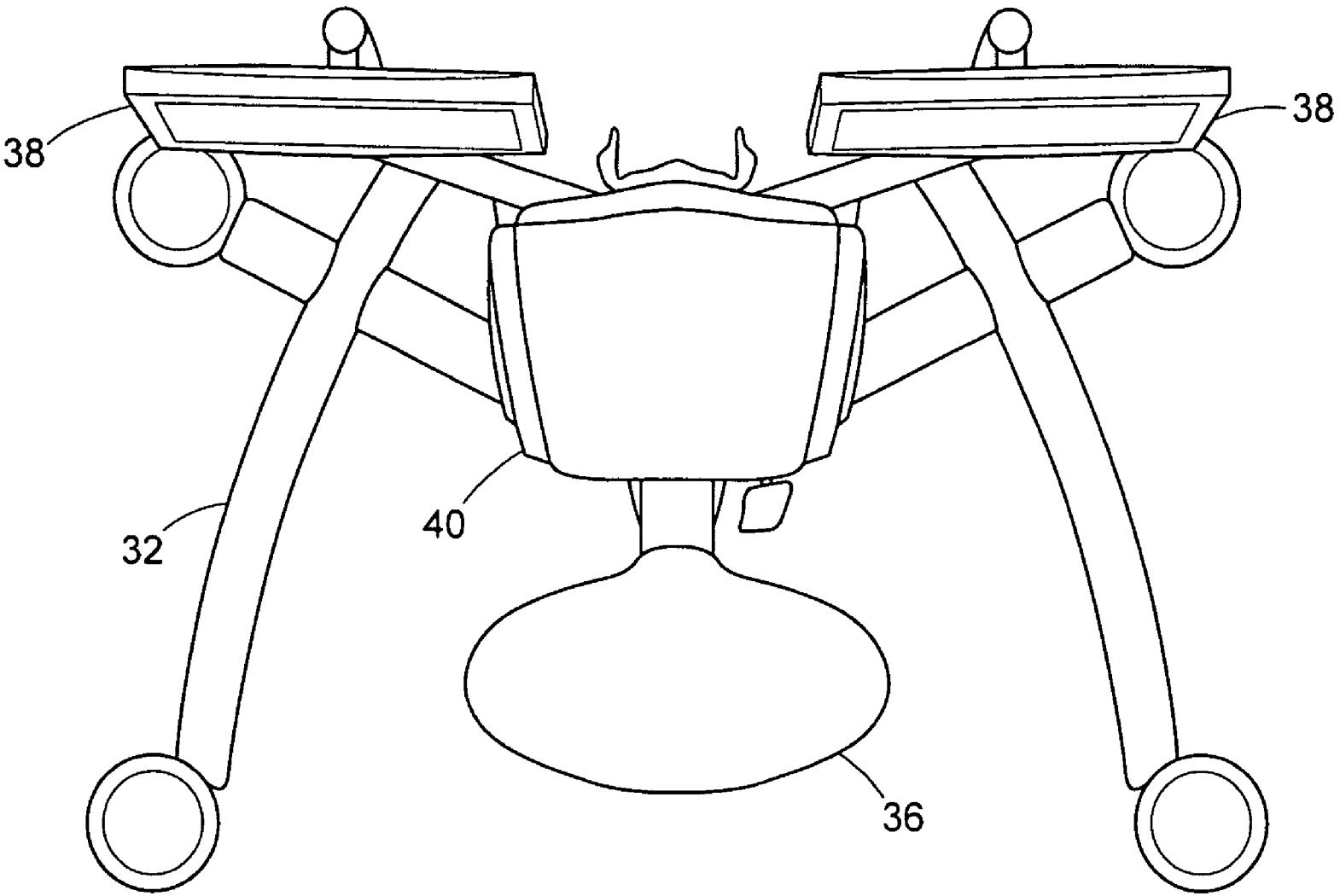
Figure 25:
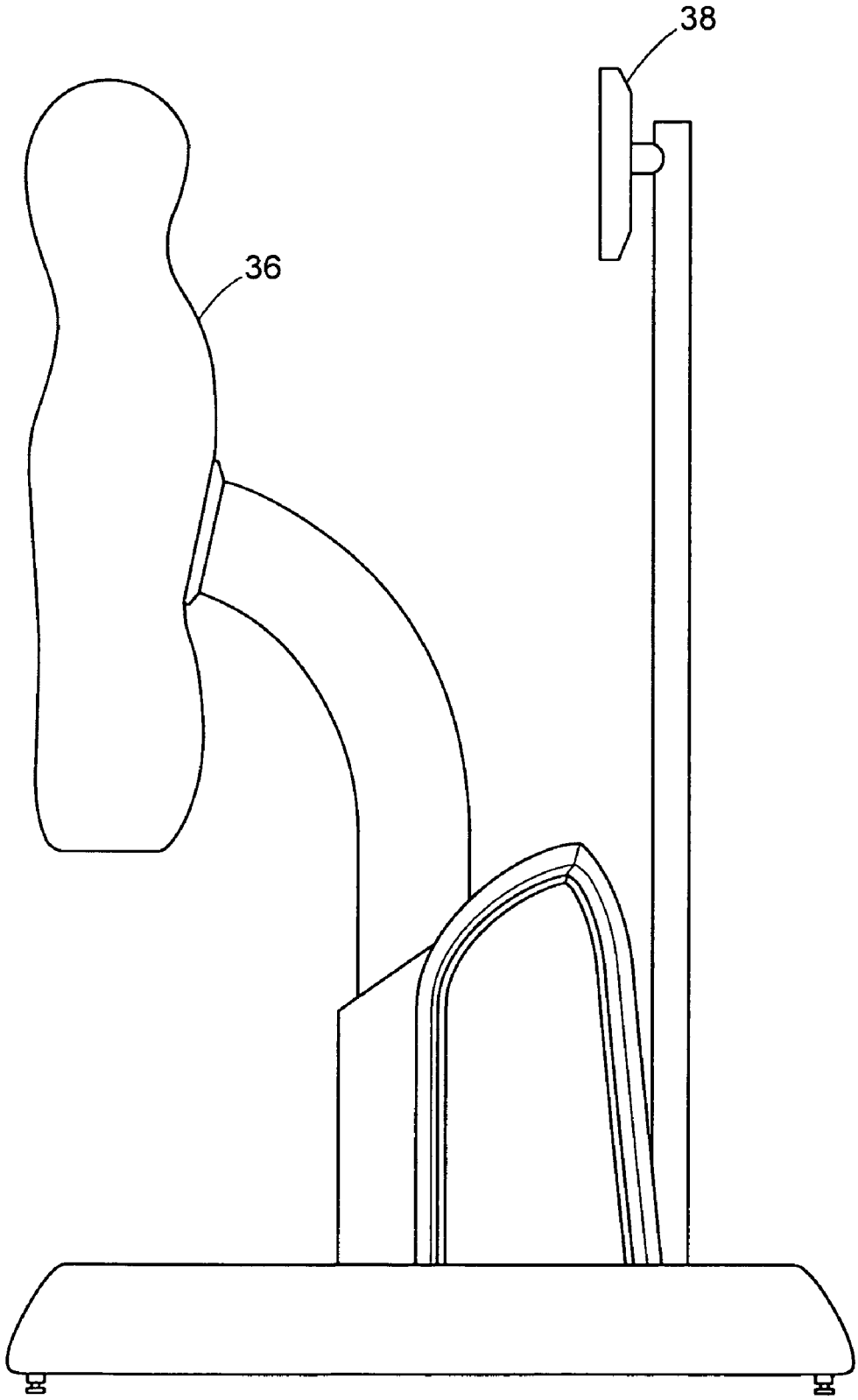
Figure 26:
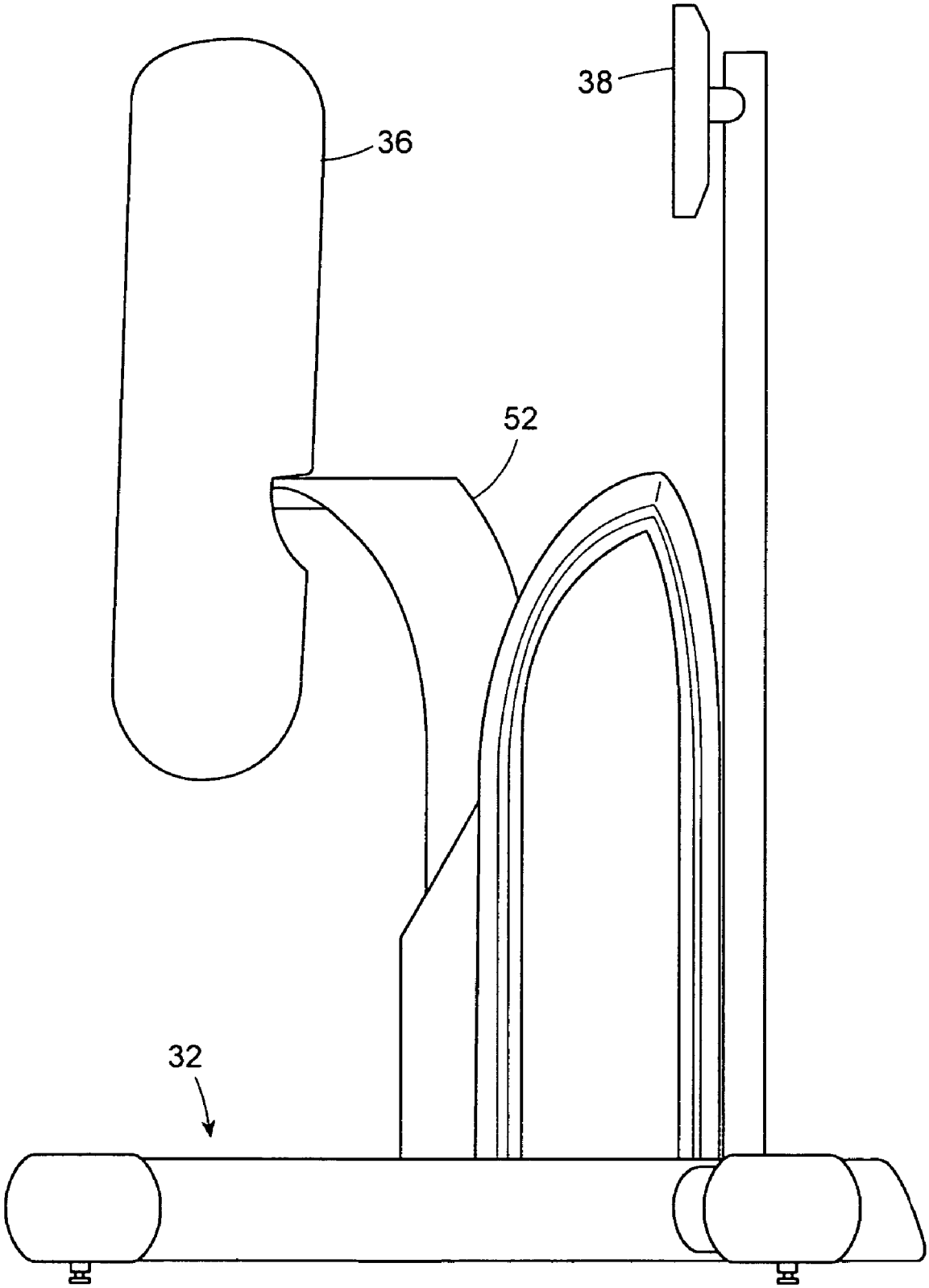
Figure 27:
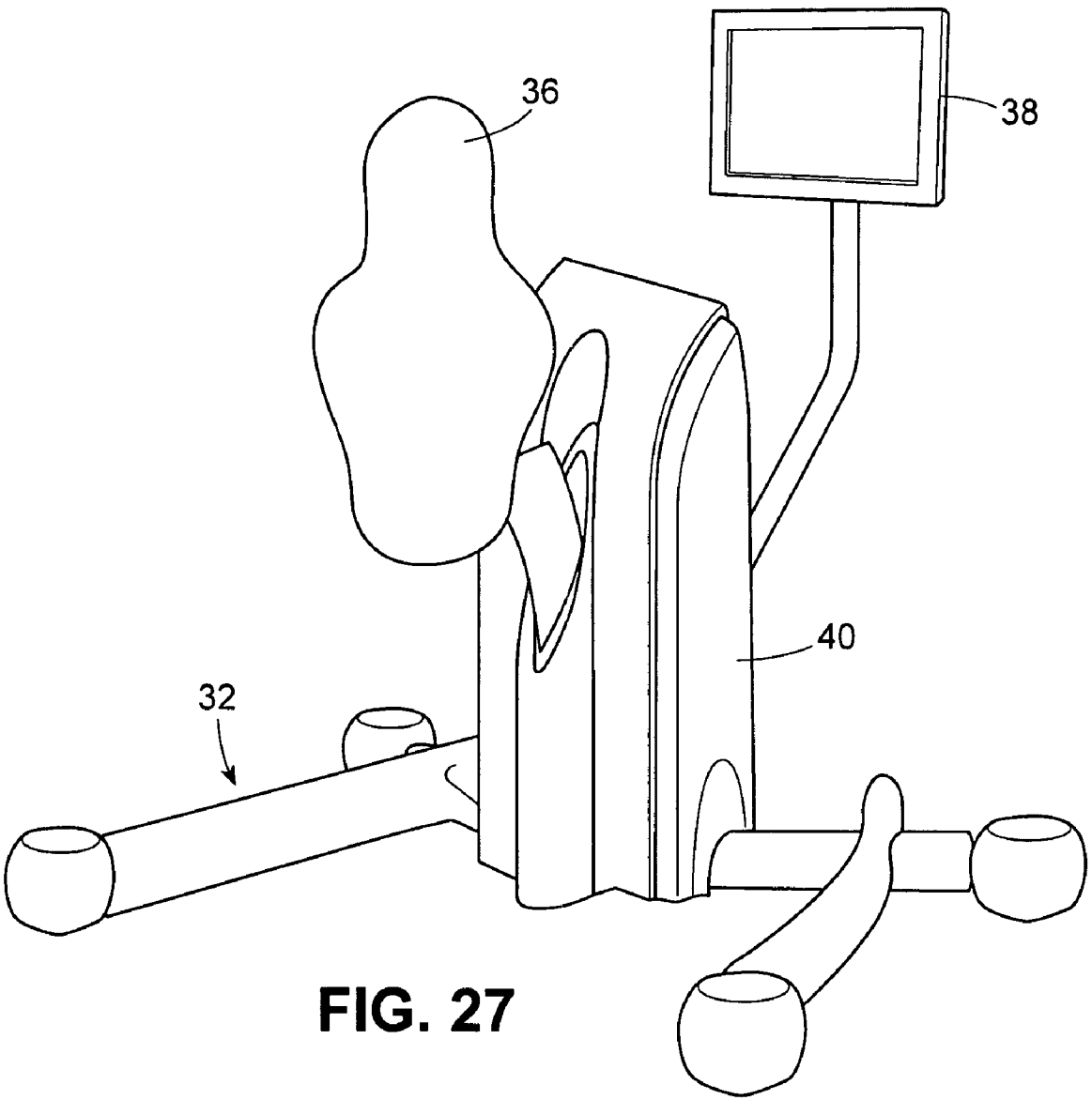

Referring to FIGS. 17 and 18, the interactive virtual personal trainer system 30 can be arranged in a tournament circuit layout. In a tournament circuit layout, a plurality of impact receiving bodies 36 can be provided, such that, for example, at least two impact receiving bodies 36 can be arranged face-to-face. During tournament play, the control unit can be arranged to request impact-dependent response routines that require the user to impact multiple impact receiving bodies 36. Accordingly, the user can be instructed to perform more complex and challenging exercises requiring a greater range of motion and variability. The results of each workout can be saved so that multiple users can compete against one another in a tournament-like atmosphere.

Referring to FIG. 19, the generation and processing of data and the generation of sounds and images are shown for a sample workout program. The variables correspond to the variables shown in FIG. 15 but could also correspond to any of the variables disclosed with respect to the discussion of FIGS. 11 and 12, or any other portion of this disclosure.

Those skilled in the art can appreciate from the foregoing description that the present teachings can be implemented in a variety of forms. Therefore, while these teachings have been described in connection with particular embodiments and examples thereof, the true scope of the present teachings should not be so limited. Various changes and modifications may be made without departing from the scope of the teachings herein.

What is claimed is:

1. A method for providing a feedback-controlled exercise routine for a user which comprises:

providing a predetermined sequence of movements for the user;

sensing movements of the user during the sequence;

measuring data related to the sensed movements;

evaluating the data to determine whether to repeat or modify the routine;

converting measured data into a response time or an amount of force, and evaluating the converted data to determine user compliance with predetermined response times or minimum applied force requirements of the exercise routine, so that the sequence can be modified to facilitate user compliance.

2. The method of claim 1, which further comprises storing the user's exercise routine on a user key.

3. The method of claim 2, which further comprises displaying exercise instructions to the user from the user key to illustrate the sequence of movements.

4. The method of claim 3, wherein the evaluation of the data includes modifying the displayed exercise instructions, and storing an updated user exercise routine on the user key after successful completion of the routine wherein the updated routine includes the modified exercise instructions.

5. The method of claim 1, wherein the predetermined sequence includes the sequential illumination of indicators and the user movements are sensed by applying an impact force to a sensor associated with the illuminated indicator.

6. The method of claim 1, wherein the measured data is converted into a response time, and further wherein the data is evaluated to determine user compliance with predetermined response times of the exercise routine, so that the sequence can be modified to facilitate user compliance.

7. The method of claim 6, wherein sequence is modified by running faster if the user was in compliance with the routine or by running slower if the user was not in compliance with the routine.

8. The method of claim 1, wherein the measured data is converted into an amount of force, and further wherein the data is evaluated to determine user compliance with predetermined minimum applied force requirements of the exercise routine, so that the sequence can be modified to facilitate user compliance.

9. The method of claim 8, wherein sequence is modified by running faster if the user was in compliance with the routine or by running slower if the user was not in compliance with the routine.

10. The method of claim 1, wherein the sequence is modified to provide a more complex routine.

11. The method of claim 10, wherein sequence is complexity is increased by varying the sequence, by running the sequence faster, by adding further requirements to the sequence or by a combination of these.

12. The method of claim 1, wherein the movements are sensed by contacting a sensor on a body.

13. The method of claim 12, wherein the body is an impact receiving body and the movements are sensed by applying an impact force to the sensor.

14. The method of claim 12, which further comprises providing a illuminable member in the sensor so that illumination of the member indicates that the sensor is to be contacted in order for the user to comply with the routine.

15. The method of claim 1, which further comprises providing an audio transmission to the user to describe or implement the routine or to provide feedback on user compliance with the routine.

16. The method of claim 1, which further comprises monitoring one or more physical parameters of the user and terminating instructions for user movements if a physical parameter exceeds a safety value.

* * * * *